US006550448B1

(12) United States Patent
Isogawa et al.

(10) Patent No.: US 6,550,448 B1
(45) Date of Patent: Apr. 22, 2003

(54) ENGINE THROTTLE VALVE LINKAGE

(75) Inventors: Atsushi Isogawa, Shizuoka (JP); Yukinori Kashima, Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/688,511

(22) Filed: Oct. 16, 2000

(30) Foreign Application Priority Data

Oct. 14, 1999 (JP) ..... 11-293052

(51) Int. Cl.[7] ..... F02D 9/10; F02D 11/04
(52) U.S. Cl. ..... 123/336; 123/400
(58) Field of Search ..... 123/59.5, 195 HC, 123/195 P, 336, 337, 400, 583, 584

(56) References Cited

U.S. PATENT DOCUMENTS

| | | | | | |
|---|---|---|---|---|---|
| 2,854,026 | A | * | 9/1958 | Ball | 123/336 X |
| 2,869,527 | A | * | 1/1959 | Groves | 123/336 X |
| 4,546,746 | A | * | 10/1985 | Sato et al. | 123/445 X |
| 4,823,748 | A | * | 4/1989 | Ampferer et al. | 123/336 |
| 4,971,006 | A | | 11/1990 | Imaeda | 123/400 |
| 4,995,370 | A | | 2/1991 | Imaeda et al. | 123/583 |
| 5,088,468 | A | | 2/1992 | Imaeda | 123/583 |
| 5,476,402 | A | * | 12/1995 | Nakai et al. | 123/195 P X |
| 5,803,044 | A | | 9/1998 | Kato | 123/336 |
| 5,875,745 | A | | 3/1999 | Watanabe et al. | 123/59.5 |
| 6,293,247 | B1 | * | 9/2001 | Sasaki et al. | 123/308 |
| 6,346,018 | B1 | * | 2/2002 | Watanabe | 123/198 R X |

* cited by examiner

*Primary Examiner*—Tony M. Argenbright
(74) *Attorney, Agent, or Firm*—Knobbe, Martens, Olson & Bear LLP

(57) ABSTRACT

An engine throttle valve linkage includes an improved construction that can be placed in a space around an engine in an internal cavity of a protective cowling so as to control throttle valves under a synchronized condition. In a preferred mode, the engine includes first and second air intake conduits communicating with combustion chambers in the respective cylinder banks of the V-shaped engine and extending generally along side surfaces of the engine body. The first and second intake conduits have first and second throttle valves, respectively, both regulating an amount of air flowing through the respective intake conduits. A manipulator actuates both the first and second throttle valves. The manipulator includes a pair of manipulating members coupled with the first and second throttle valves. The manipulator is disposed generally between the first and second air intake conduits so as to be positioned on the engine body.

30 Claims, 18 Drawing Sheets

ENGINE THROTTLE VALVE LINKAGE

PRIORITY INFORMATION

This invention is based on and claims priority to Japanese Patent Application No. Hei 11-293052, filed Oct. 14, 1999, the entire contents of which is hereby expressly incorporated by reference.

BACKGROUND OF THE INVENTION

1. Field of the Invention

This invention relates to an engine throttle valve linkage, and more particularly to a throttle valve control linkage suitable for an outboard motor engine.

2. Description of Related Art

A typical outboard motor is powered by an internal combustion engine. The engine is disposed atop the outboard motor and is surrounded by a protective cowling. Normally, with increased engine performance (i.e., higher horsepower), the engine become larger. Because of this, the engine of large outboard motors are often V-shaped. The V-shaped engine usually has six or more cylinders to produce a large power output. Such engines also require a large cowling. It is, however, desirably to keep the cowling size as small as compact as possible in order to minimize drag on the watercraft.

With this design parameter in mind, a space in an internal cavity of the cowling is extremely limited, but nevertheless must accommodate many engine-related components. A throttle valve linkage is one of these components.

The engine includes an air induction system that is arranged to supply air to combustion chambers of the engine. The air induction system for the V-shape engine commonly includes a pair of air intake conduits that, for example, extend along both sides of the engine. Each intake conduit has a throttle valve that admits a desired amount of air to flow therethrough in response to various running conditions of the engine.

Generally, valve opening degrees of the respective throttle valves should be the same as each other. The throttle valves on the respective banks of the V-configuration are thus desirably controlled under a synchronized condition. A linkage system is provided for this synchronized control. It is, however, difficult to arrange the linkage system neatly and compactly in the narrow space between the engine side and a sidewall of the cowling.

If the engine requires a number of parts or members for arranging the valve linkage in the narrow space, another problem arises. The costs associated with manufacturing these parts and assembling them on the engine increases the overall production cost of the outboard motor.

In addition, because of separated in two intake conduits, the throttle valves on both banks may not synchronize accurately with each other. This situation can occur if the valve linkage is used for a long period or tolerances in manufacturing or assembling processes.

SUMMARY OF THE INVENTION

An improved throttle valve linkage system is provided within the space around the engine in the internal cavity of the protective cowling so as to control the throttle valves under a synchronized condition. In a preferred mode, the throttle valve linkage can adjust for discrepancies in the movement of the throttle valve on both banks so as to synchronize them accurately. In addition, the throttle valve linkage preferably is configured so as to be more easily arranged and assembled on the engine to reduce the manufacturing costs associated with the outboard motor. These aspects of the present invention may be practiced together or apart from each other.

In accordance with one aspect of the present invention, the throttle valve linkage system is used to control the throttle valves on both cylinder banks of the V-shaped internal combustion engine. The engine includes a cylinder block that defines at least two cylinder bores. The cylinder bores are arranged relative to each other in a V-shaped configuration. Pistons reciprocate within the respective cylinder bores. A cylinder head member closes one end of each of the cylinder bores and defines a combustion chamber with the respective cylinder bore and piston. A crankshaft is coupled to the pistons and a crankcase member closes the other ends of the cylinder bores. The cylinder block, the cylinder head member and the crankcase member together defines an engine body. A first air intake conduit communicates with one of the combustion chambers on one cylinder bank and extends generally along a side surface of the engine body. A second air intake conduit communicates with another one of the combustion chambers on the other cylinder bank and extends generally along another side surface of the engine body. The first air intake conduit has a first throttle valve that regulates an amount of air flow through the first air intake conduit. The second air intake conduit has a second throttle valve that regulates an amount of air flow through the second air intake conduit. A manipulator is provided for actuating both the first and second throttle valves. The manipulator includes a pair of manipulating members coupled with the first and second throttle valves. The manipulator is disposed generally between the first and second air intake conduits so as to be positioned on the engine body.

In accordance with another aspect of the present invention, an internal combustion engine comprises a cylinder block. The cylinder block defines at least two cylinder bores spaced apart from each other in a V-shaped configuration. Pistons reciprocate within the respective cylinder bores. Cylinder head members close the ends of the cylinder bores on one side and define combustion chambers with the cylinder bores and the pistons. A crankshaft is coupled with the pistons and a crankcase member closes the other ends of the cylinder bores. The cylinder block, the cylinder head member and the crankcase member together defines an engine body. A first air intake conduit communicates with one of the combustion chambers and extends generally along a side surface of the engine body. A second air intake conduit communicates with another one of the combustion chambers and extends generally along another side surface of the engine body. The first air intake conduit has a first throttle valve arranged for pivotal movement about a first valve axis. The second air intake conduit has a second throttle valve arranged for pivotal movement about a second valve axis. A manipulator is affixed to the engine body for pivotal movement about a third axis. The manipulator includes a pair of coupling rods connected to the first and second throttle valves. The first and second throttle valves pivot about the first and second axes, respectively, by the coupling rods when the manipulator pivots about the third axis.

In accordance with an additional aspect of the present invention, an internal combustion engine comprises a cylinder block. The cylinder block defines at least one cylinder bore. A piston reciprocates within the cylinder bore. A cylinder head member closes one end of the cylinder bore and defines a combustion chamber with the cylinder bore and the piston. The cylinder block further defines a lubricant passage through which lubricant passes. The lubricant passage has an open end. A closure member closes the open end. An air intake conduit communicates with the combustion chamber. The air intake conduit includes a throttle valve that regulates air flow to the combustion chamber. A valve actuator is arranged to actuate the throttle valve. The valve actuator is affixed to the closure member.

In accordance with a still further aspect of the present invention, an internal combustion engine comprises a cylinder block. The cylinder block defines at least two cylinder bores arranged in a V-shape configuration. Pistons reciprocate within the respective cylinder bores. Cylinder head members close the ends of the cylinder bores on one side of the engine and define combustion chambers with the cylinder bores and the pistons. A first air intake conduit communicates with one of the combustion chambers and a second air intake conduit communicates with another one of the combustion chambers. The first air intake conduit has a first throttle valve arranged to regulate the air flow through the first air intake conduit. The second air intake conduit has a second throttle valve arranged to regulate the air flow through the second air intake conduit. A manipulator simultaneously actuates both the first and second throttle valves. The manipulator includes a pair of connecting members coupled with the first and second throttle valves. An adjustment mechanism is arranged to adjust positions of both the first and second throttle valves so that the respective air flow through the first and second air intake conduits are generally same as each other. The adjustment mechanism is disposed between at least one of the connecting members and one of the first and second throttle valves.

Further aspects, features and advantages of this invention will become apparent from the detailed description of the preferred embodiment which follows.

BRIEF DESCRIPTION OF THE DRAWINGS

These and other features of this invention will now be described with reference to the drawings of a preferred embodiment which is intended to illustrate and not to limit the invention. The drawings contain the following figures.

A

DETAILED DESCRIPTION OF THE PREFERRED EMBODIMENT OF THE INVENTION

Figure 1:
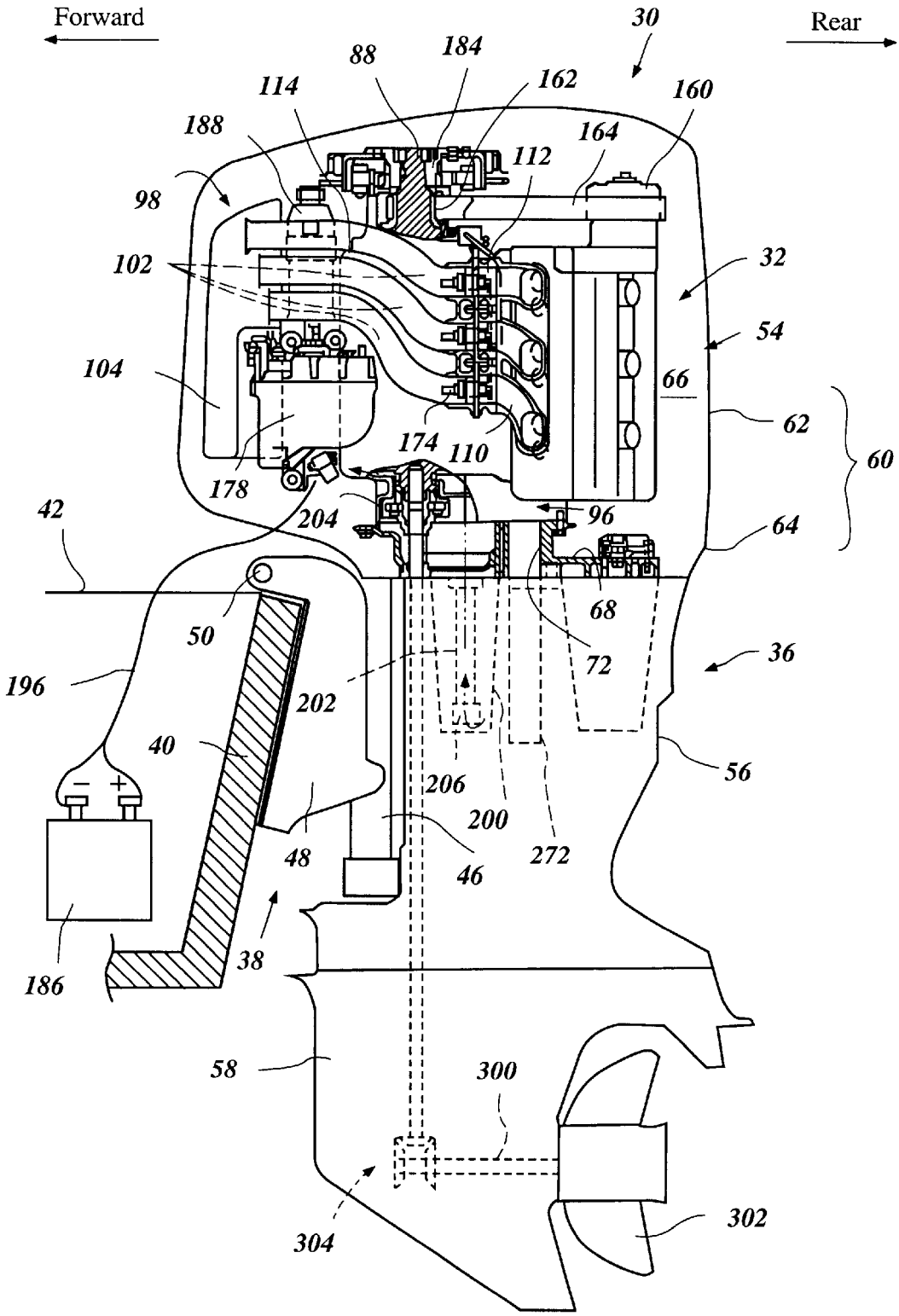
FIG. 1 is a schematic side elevational view of an outboard motor employing an engine configured in accordance with a preferred embodiment of the present invention. An associated watercraft is partially shown in section, and a portion of the cowling is removed to expose the engine. Several portions of the engine are also sectioned.

With primary reference to FIG. 1, an outboard motor 30 employs an internal combustion engine 32 configured in accordance with a preferred embodiment of the present invention. Although the present invention is shown in the context of an engine for an outboard motor, various aspects and features of the present invention also can be applied to engines for other types of marine outboard drive units (e.g., a stem drive unit or an inboard motor of a personal watercraft) and also to other engines (e.g., land vehicle engines and stationary engines).

In the illustrated embodiment, the outboard motor 30 comprises a drive unit 36 and a bracket assembly 38. The bracket assembly 38 supports the drive unit 36 on a transom 40 of an associated watercraft 42 so as to place a marine propulsion device in a submerged position with the watercraft 42 floating on the surface of a body of water. The bracket assembly 38 comprises a swivel bracket 46, a clamping bracket 48, a steering shaft and a pivot pin 50.

The steering shaft extends through the swivel bracket 46 and is affixed to the drive unit 36 by an upper mount assembly and a lower mount assembly. The steering shaft is pivotally journaled for steering movement about a generally vertically extending steering axis within the swivel bracket 46. A steering handle extends upwardly and forwardly from the steering shaft to steer the drive unit 36. The clamping bracket 48 includes a pair of bracket arms spaced apart from each other and affixed to the transom 40 of the associated watercraft 42. The pivot pin 50 completes a hinge coupling between the swivel bracket 46 and the clamping bracket 48. The pivot pin 50 extends through the bracket arms so that the clamping bracket 48 supports the swivel bracket 46 for pivotal movement about a generally horizontally extending tilt axis of the pivot pin 50. Although not shown, a hydraulic tilt and trim adjustment system is provided between the swivel bracket 46 and the clamping bracket 48 to tilt up and down and also for the trim adjustment of the drive unit 36.

As used through this description, the terms "fore," "front," "forward" and "forwardly" mean at or to the side where the clamping bracket 48 is located, and the terms "aft," "rear," "reverse" and "rearwardly" mean at or to the opposite side of the front side, unless indicated otherwise or otherwise readily apparent from the context of use.

The drive unit 36 includes a power head 54, a driveshaft housing 56 and a lower unit 58. The power head 54 is disposed atop the drive unit 36 and includes the engine 32 and a protective cowling assembly 60. The protective cowling assembly 60 includes a top cowling member 62 and a bottom cowling member 64.

The protective cowling assembly 60 generally completely surrounds the engine 32 so as to enclose it in a closed cavity 66. The top cowling member 62 is detachably affixed to the bottom cowling member 64 with a conventional coupling mechanism (e.g., hook type) 65 so that the operator can access the engine 32 for maintenance or for other purposes.

As is well known, the top cowling member 62 has an air intake port disposed on its rear, top portion. A pair of air intake ducts is provided at a position adjacent to the intake port so that ambient air enters the closed cavity 66 through the port and the intake ducts. The top cowling member 62 is narrowed upwardly.

The bottom cowling member 64 has an opening at its bottom portion through which an upper portion of an exhaust guide member 68 extends. The exhaust guide member 68 is affixed atop the driveshaft housing 56. The bottom cowling member 64 and the exhaust guide member 68 thus generally form a tray. The engine 32 is placed onto this tray and is affixed to the exhaust guide member 68 so as to be supported thereby. A gasket 70 (FIG. 11) is interposed between the engine 32 and the exhaust guide member 68. The exhaust guide member 68 also has an exhaust passage 72 through which burnt charges (e.g., exhaust gases) from the engine 32 are discharged as described below.

Figure 3:
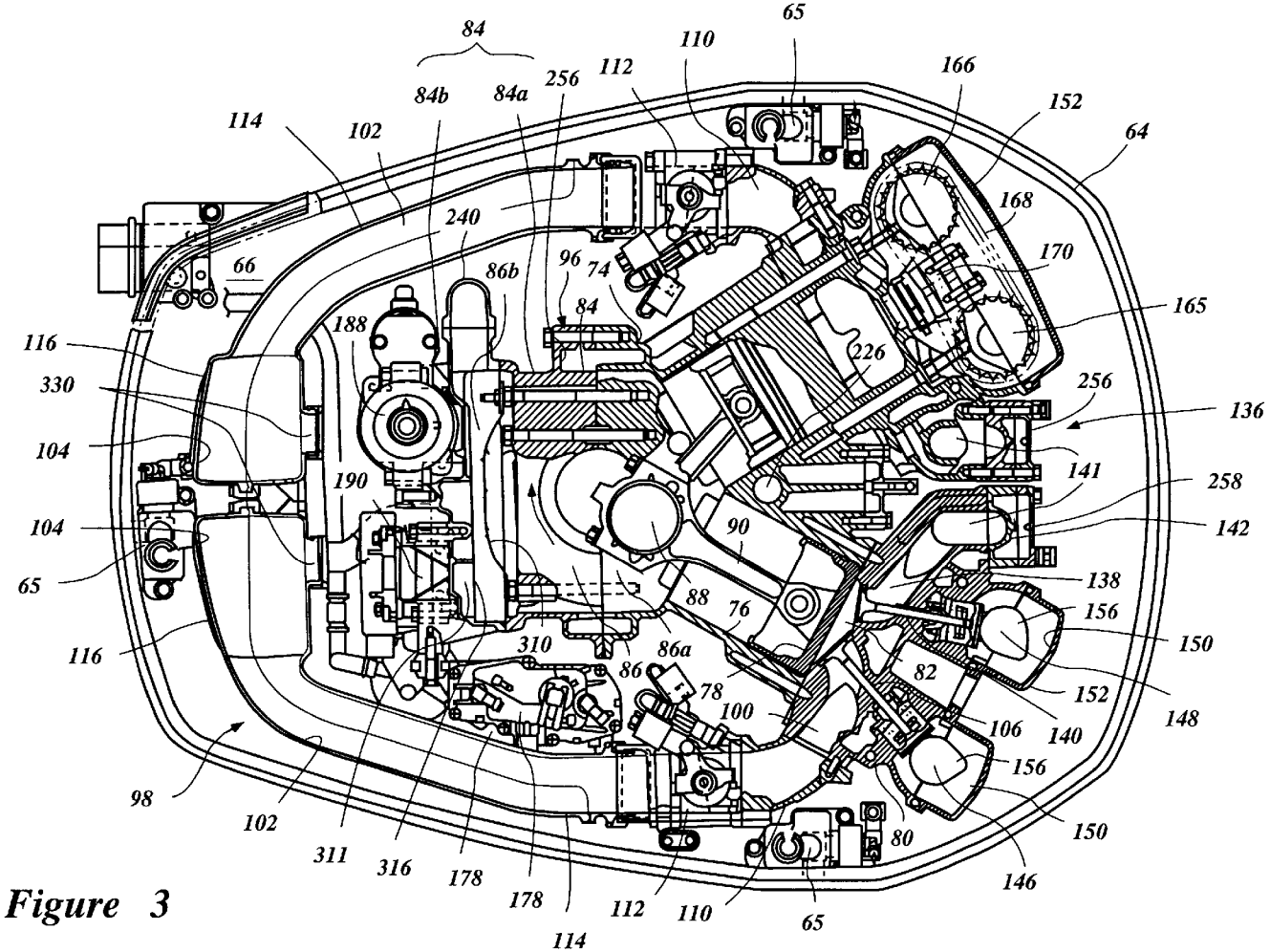
FIG. 3 is a top plan view of the power head shown in a manner similar to that illustrated in FIG. 2 except that the engine and its air induction system are illustrated in section.
Figure 4:
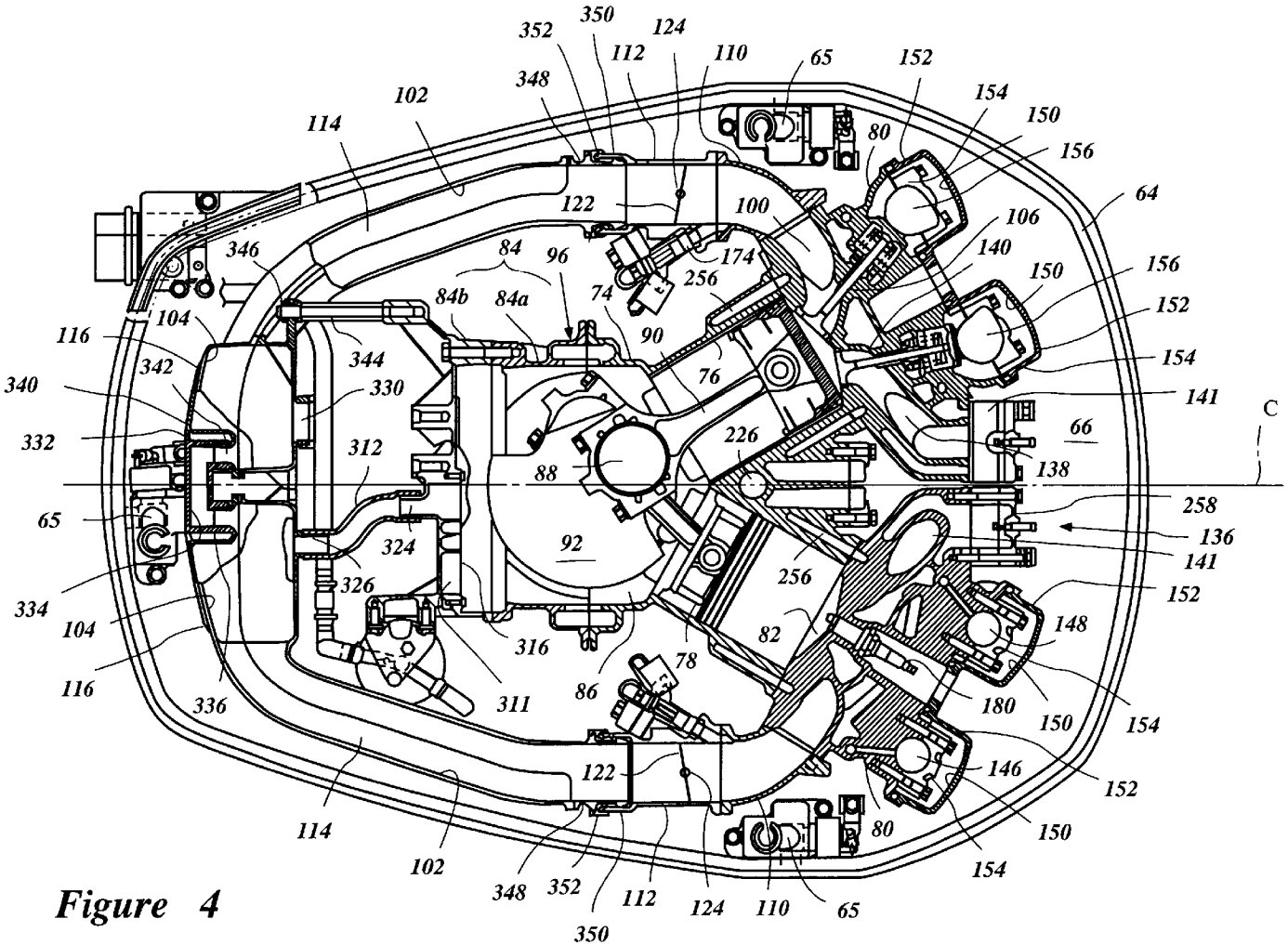
FIG. 4 is a top plan view of the power head shown in a manner similar to that illustrated in FIG. 3 except that an oil filter and some electrical components of the engine (e.g., an Electronic Control Unit) are omitted in order to reveal a breather tube.

The engine 32 in the illustrated embodiment operates on a four-stroke cycle combustion principle and powers a propulsion device. The engine 32 has a cylinder block 74. The cylinder block 74 defines six cylinder bores 76. The cylinder block 74 is generally configured as a V-shape to form two banks so that adjacent cylinder bores 76 are spaced apart horizontally from each other in a plan view as seen in FIGS. 3 and 4, although they are slightly off-set vertically, as known in the art. While in the illustrated embodiment the cylinder block 74 is form of a single member, it is understood that the cylinder block can formed as an assembly of components.

In the illustrated embodiment, each bank of the cylinder block 74 includes three cylinder bores 76 that extend generally horizontally and are spaced apart vertically from each other. That is, the engine 32 is a horizontal cylinder, V6 type. This type of engine, however, merely exemplifies one type of engine on which various aspects and features of the present invention can be used. Engines having other number of cylinders, having other cylinder arrangements, and operating on other combustion principles (e.g., crankcase compression two-stroke or rotary) are all practicable.

Figure 2:
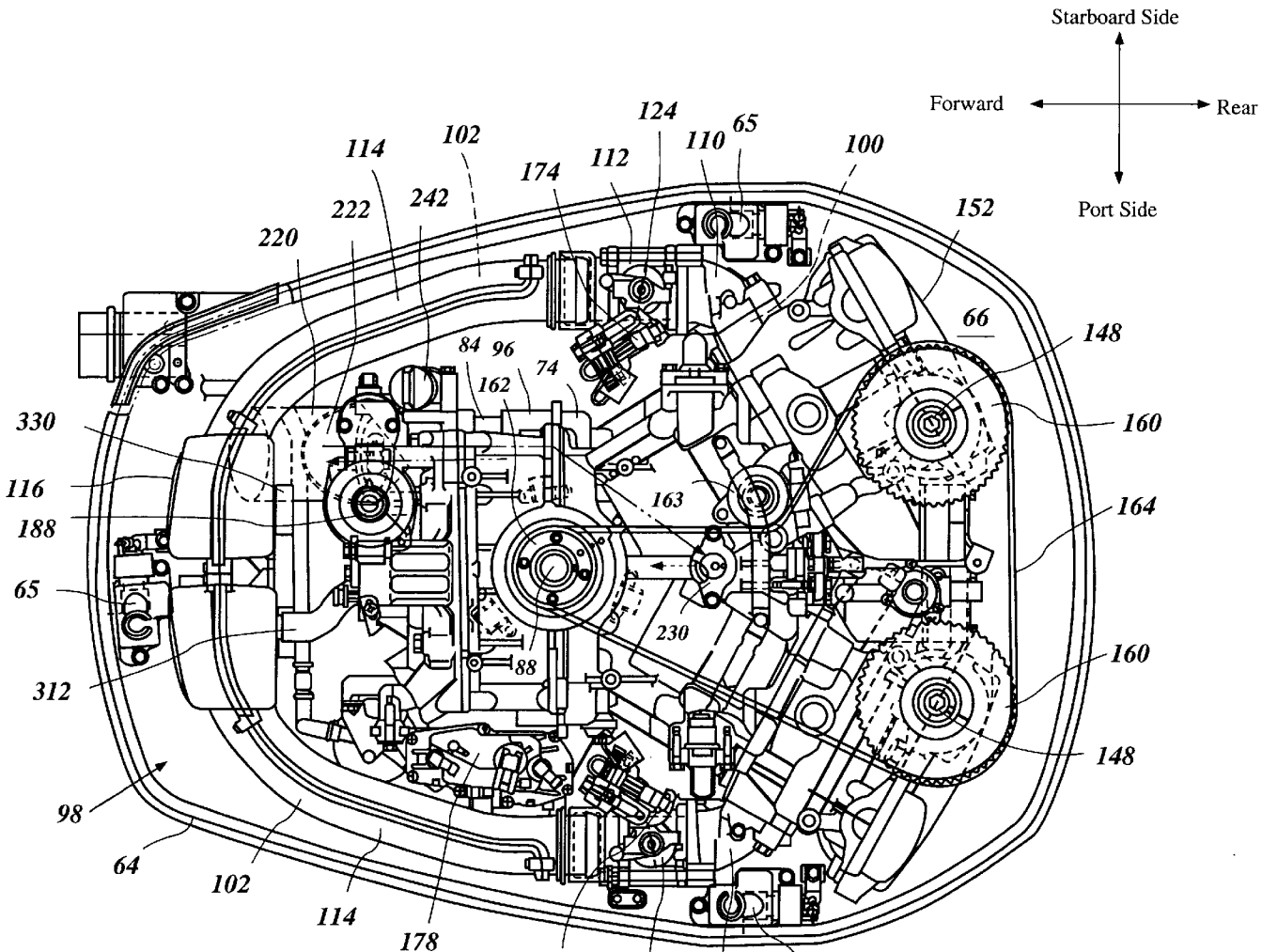
FIG. 2 is a top plan view of a power head of the outboard motor. A top cowling member of the power head is detached to show the engine. A throttle valve linkage is omitted.

As seen in FIGS. 2 and 3, a piston 78 reciprocates in each cylinder bore 76. A pair of cylinder head members 80 is affixed to one ends of the cylinder block 74 for closing the cylinder bores 76 of the respective banks. The cylinder head members 80 define six combustion chambers 82 with the pistons 78 and the cylinder bores 76. Each bank has three combustion chambers 82 in the illustrated embodiment.

Figure 11:
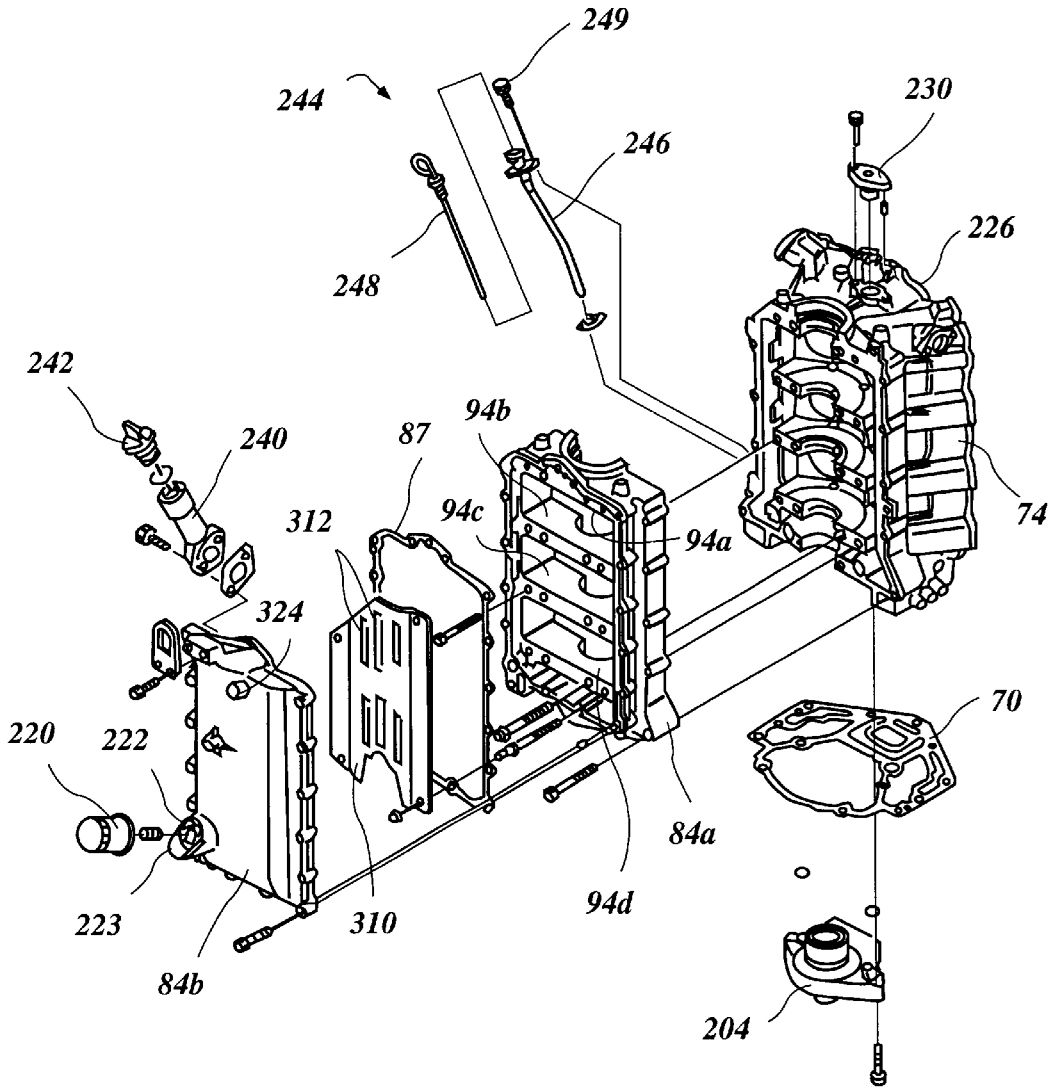
FIG. 11 is an exploded view of the engine including the cylinder block, the crankcase member, the crankcase cover, a baffle plate and the oil pump unit.

A crankcase assembly 84 closes the other ends of the cylinder bores 76 and defines a crankcase chamber 86 with the cylinder block 74. In the illustrated embodiment, the crankcase assembly 84 comprises two pieces, i.e., a crankcase member or inner member section 84*a* and a crankcase cover or outer member section 84*b*. The crankcase cover 84*b* is affixed to the crankcase member 84*a* via a gasket 87 (FIG. 11). The crankcase assembly 84, however, can be defined by a single piece.

Figure 5:
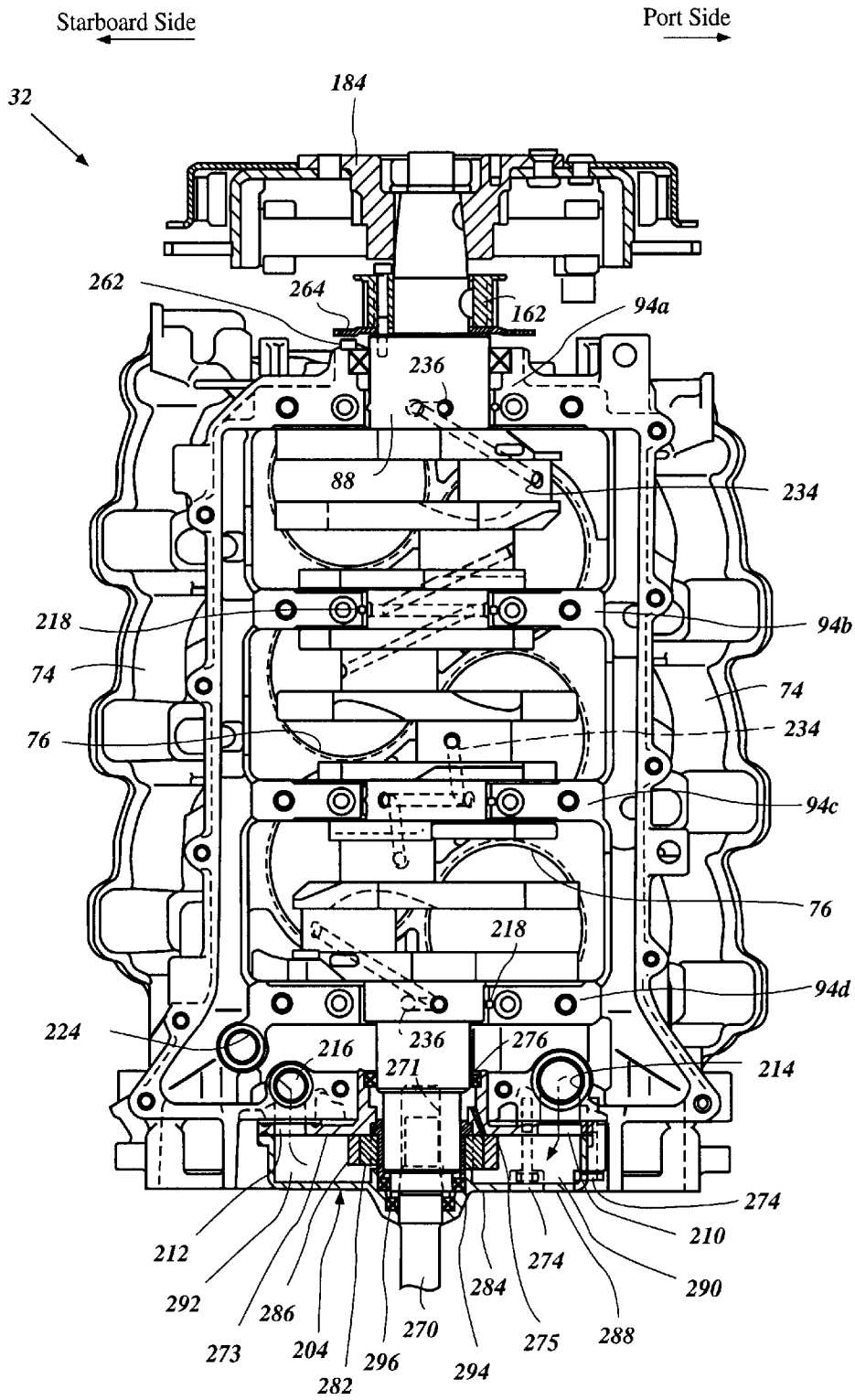
FIG. 5 is a front view of the engine with a crankcase member removed. Some portions of the engine, including an oil pump unit, are shown in section.

A crankshaft 88 extends generally vertically through the crankcase chamber 86. The crankshaft 88 is rotatably coupled with the respective pistons 78 by connecting rods 90 and thus rotates with the reciprocal movement of the pistons 78. The crankshaft 88 has counter weights 92 disposed opposite of the throws to which the pistons 78 are coupled so as to effectively balance the rotation of the crankshaft. The crankshaft 88 is journaled by bearing blocks, which are defined by end portions of the cylinder block 74 and the crankcase member 84*a*. As best seen in FIG. 5, the bearing blocks comprise a top bearing portion 94*a*, intermediate bearing portions 94*b*, 94*c* and a bottom bearing portion 94*d*. Additional details of the crankcase assembly 84 and the crankcase chamber 86 will be described below.

The crankcase assembly 84 is located at the most forward position, then the cylinder block 74 and the cylinder head member 80 are disposed rearward from the crankcase assembly 84 one after another. The cylinder block 74, the cylinder head member 80 and the crankcase assembly 84 together define an engine body 96. At least, these major engine components 74, 80, 84 preferably are made of aluminum alloy.

The engine 32 includes an air induction system 98. The air induction system 98 supplies air from the closed cavity 66 of the cowling assembly 60 to the combustion chambers 82. As seen in FIGS. 2 to 4, the air induction system 98 includes intake ports 100, a pair of intake passages 102 and a pair of plenum chambers 104.

Twelve intake ports 100 are provided, six of which are disposed on the cylinder bank on the starboard side and another six of which are disposed on the other cylinder bank on the port side. That is, each cylinder bore 76 has two intake ports 100. The intake ports 100 are defined in the respective cylinder head members 80 on the outer sides of the respective cylinder banks. The intake ports 100 are opened and closed by intake valves 106.

Three intake passages 102 extend from the respective intake port pairs 100 of one of the bank generally along a side surface of the cylinder block 74 and the crankcase assembly 84 on the starboard side, while another three intake passages 102 extend from the intake port pairs 100 of the other bank along the other side surface of the cylinder block 74 and the crankcase assembly 84 on the port side. When each intake port pairs 100 is opened, the corresponding intake passage 102 communicates with the associated combustion chamber 82.

Figure 7:
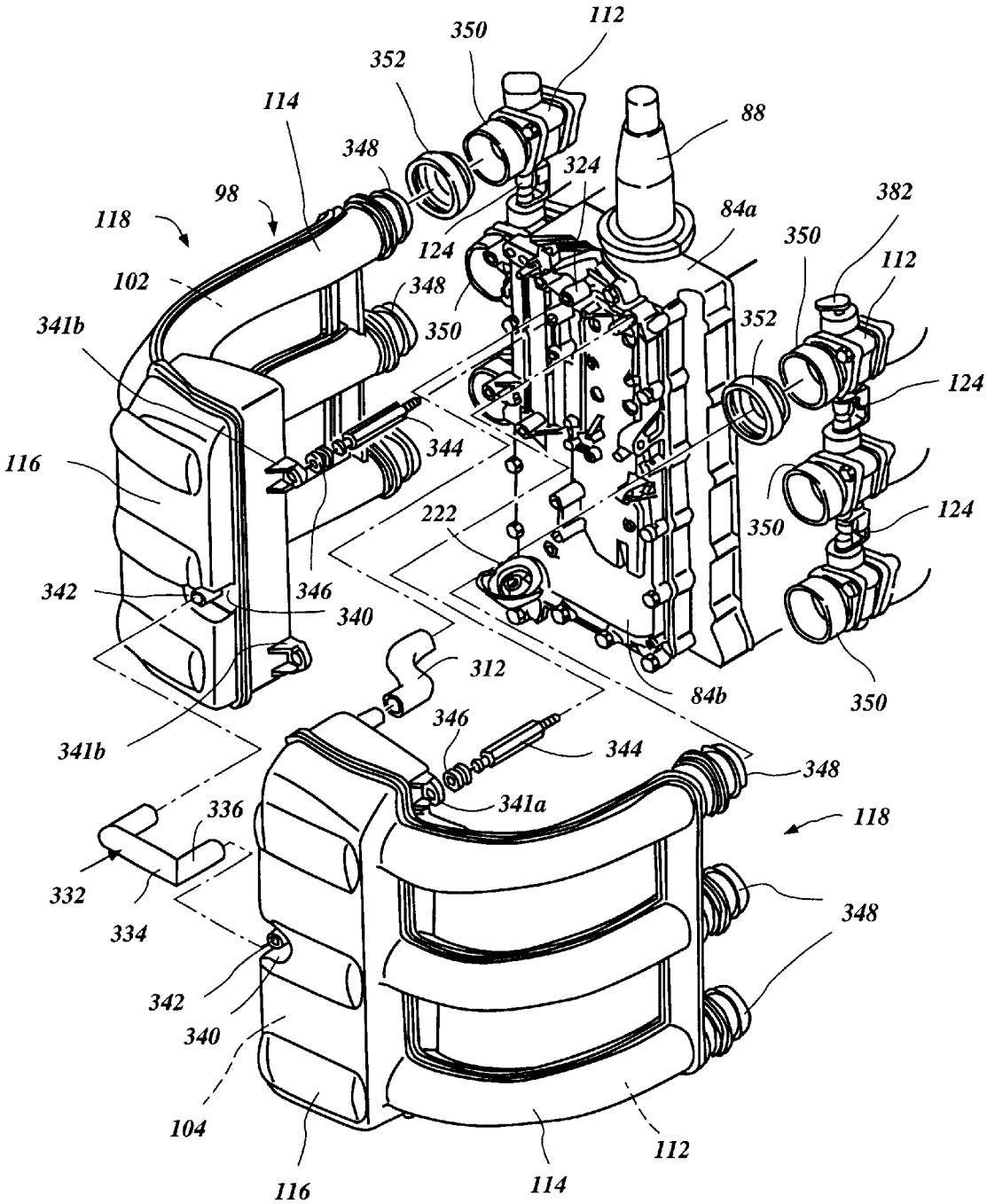
FIG. 7 is an exploded view of the engine including the crankcase member, the crankcase cover, the crankshaft and a major portion of the air induction system. Electrical components are omitted.

The air intake passages 102 are actually defined by intake manifolds 110, throttle bodies 112 and intake runners 114, while plenum chamber members 116 define the plenum chambers 104. In the illustrated embodiment, the intake manifolds 110, the throttle bodies 112, the intake runners 114 and the plenum chamber members 116 together define air intake conduits. Each intake manifold 110 is affixed to the cylinder head member 80. As best seen in FIG. 7, in the illustrated embodiment, the intake runners 114 on each bank are unified with one of the plenum chamber members 116 that is positioned to form a pair of intake units 118. The throttle bodies 112 are interposed between the intake manifolds 110 and the intake runners 114. The respective plenum chambers 104 are thus coupled to the associated intake ports 100 through the intake passages 102 defined by the intake runners 114, the throttle bodies 112 and the intake manifolds 110.

The intake manifolds 110 and the throttle bodies 112 preferably are made of aluminum alloy. The intake units 118 each including the intake runners 114 and the plenum chamber member 116 preferably are made of plastic material or aluminum alloy. The intake units 118 are produced by, for example, a conventional cast method. Of course, these engine components can be made of other materials and by other conventional manufacturing processes.

Figure 9:
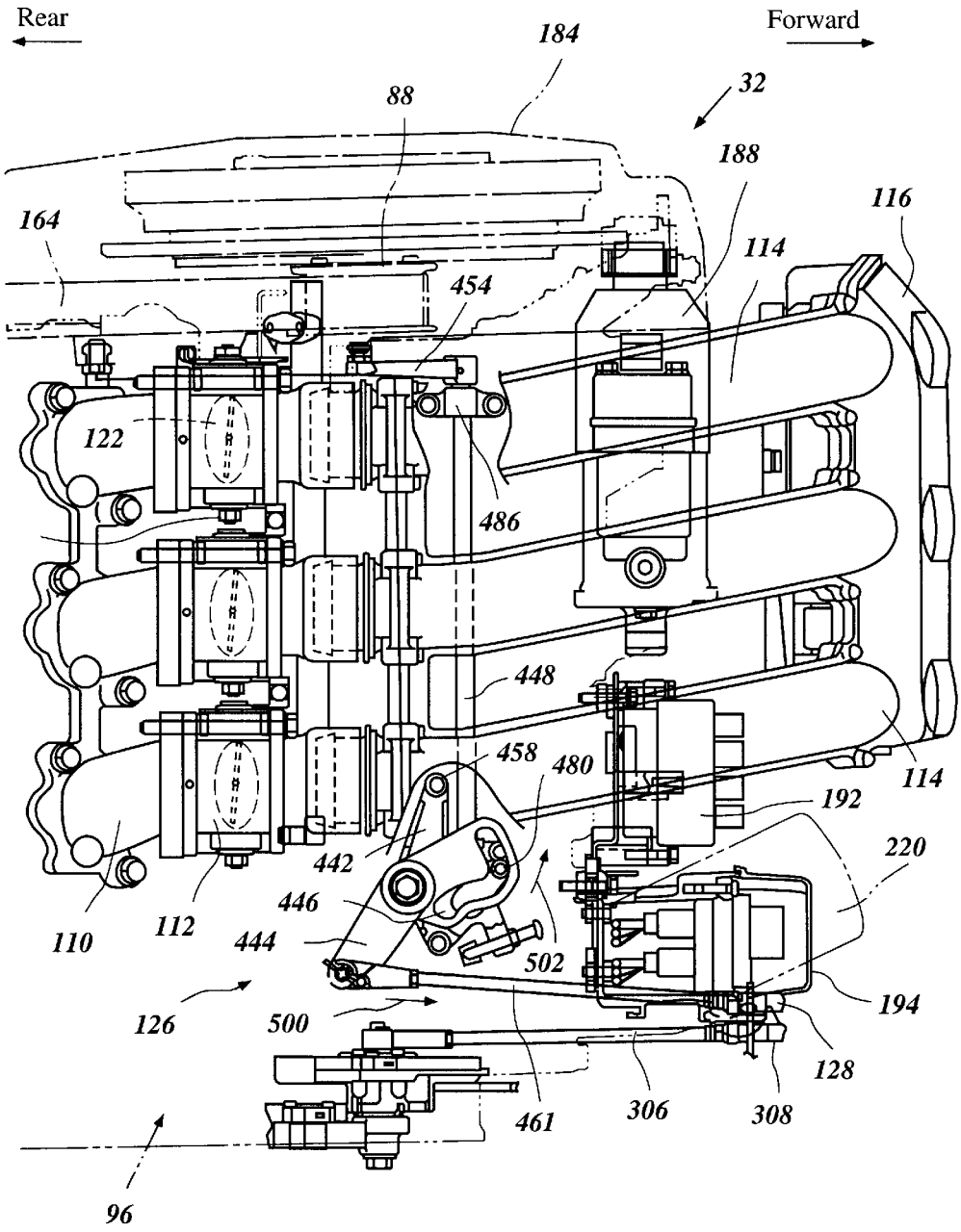
FIG. 9 is a schematic side view of the engine, specifically, the starboard side.

The respective throttle bodies 112 support throttle valves 122. In the illustrated embodiment, the throttle valves 122 are butterfly valves and disposed in the throttle bodies 112 for pivotal movement about axes of valve shafts 124 which extend generally vertically. The valve shafts 124 are linked together to form a single valve shaft that passes through the entire throttle bodies 112. The throttle valves 122 are operable by the operator through a throttle valve linkage 126 and a throttle cable 128 (FIG. 9). The throttle valves 122 are provided to regulate an amount of air flowing through the respective air intake passages 102. In other words, the amounts of air flow through the intake passages 102 are variable by changing the positions or opening degrees of the throttle valves 122. The throttle valve linkage 126 will be described in great detail later with primary reference to FIGS. 9, 15 and 16.

The engine 32 includes an exhaust system 136 that discharges the burnt charge (e.g., exhaust gases) outside of the outboard motor 30. Twelve exhaust ports 138 are provided, six of which are disposed at the cylinder bank on the starboard side, and another six of which are disposed at the other cylinder bank on the port side. That is, each cylinder bore 76 has two exhaust ports 138. The exhaust ports 138 are defined in the respective cylinder head members 80 on the opposite sides of the respective banks relative to the intake ports 100, i.e., inner sides of the banks. The exhaust ports 138 are opened and closed by exhaust valves 140. The respective banks have exhaust passages 141 extending generally vertically and parallel to each other in a space defined between both banks. The exhaust passages 141 are defined by and between the cylinder block 74 and exhaust members 142. When the exhaust ports 138 are opened, the combustion chambers 82 communicate with the exhaust passages 141. The exhaust passages 141 in turn communicate with the exhaust passage 72 of the exhaust guide member 68.

Each cylinder bank has an intake camshaft 146 and an exhaust camshaft 148, and both shafts extend extending generally vertically and parallel to each other. Because of the foregoing positions of the intake and exhaust ports 100, 138, both the exhaust camshafts 148 are positioned next to each other, and the respective intake camshafts 146 are spaced apart from each other so as to interpose both the exhaust camshafts 148 between the intake camshafts 146. The respective camshafts 146, 148 extend within camshaft chambers 150 that are defined by the cylinder head members 80 and camshaft covers 152. The camshafts 146, 148 are journaled by the cylinder head members 80 and rotatably affixed thereto by camshaft caps 154. The intake camshafts 146 actuate the intake valves 106, while the exhaust cam shafts 148 actuate the exhaust valves 140. The respective camshafts 146, 148 have cam lobes 156 to push the intake and exhaust valves 106, 140 at certain timings to open and close the intake and exhaust ports 100, 138, respectively. A single camshaft can replace the intake and exhaust camshafts 146, 148 at each cylinder bank in a manner that is well known.

Figure 15:
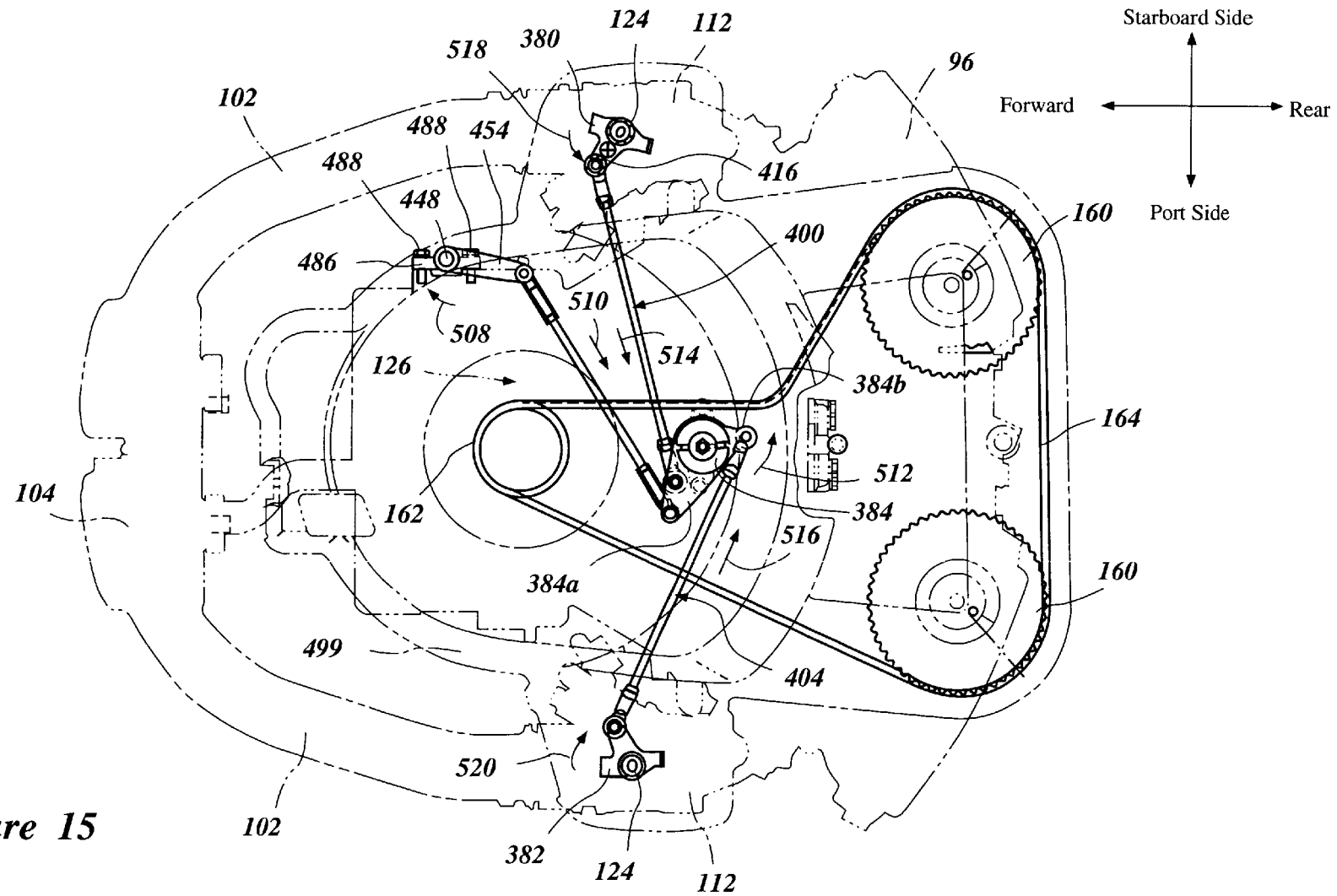
FIG. 15 is a top plan view of the engine including the throttle valve linkage. The engine portions except the valve linkage and a camshaft drive are shown in phantom.

As seen in FIGS. 2 and 15, the crankshaft 88 drives the exhaust camshafts 148. The exhaust camshafts 148 have driven sprockets 160 fitted thereto, while the crankshaft 88 also has a drive sprocket 162 fitted thereto. A guide or idle roller 163 is also provided. A timing belt or chain 164 is wound around the drive and driven sprockets 162, 160 and the guide roller 163. When the crankshaft 88 rotates, the exhaust camshafts 148 also rotate.

As seen in FIG. 3, the exhaust camshafts 148 drive the intake camshafts 146. The exhaust camshafts 148 have drive sprockets 165, while the intake camshafts 146 have driven sprockets 166. Timing belts or chains 168 are wound around the respective drive and driven sprockets 165, 166. Chain guide members 170 are provided for guiding the belts 168. With rotation of the exhaust camshafts 148, the intake camshafts 146 rotate also.

The driven sprockets 160 of the exhaust camshafts 148 have diameters twice as large as the diameter of the drive sprocket 162 of the crankshaft 88 such that the exhaust camshafts 148 rotate at half the speed of the crankshaft 88. The drive sprockets 165 of the exhaust camshafts 148 and the driven sprockets 166 have the same diameter so that the camshafts 146, 148 rotate at the same speed.

Figure 12:
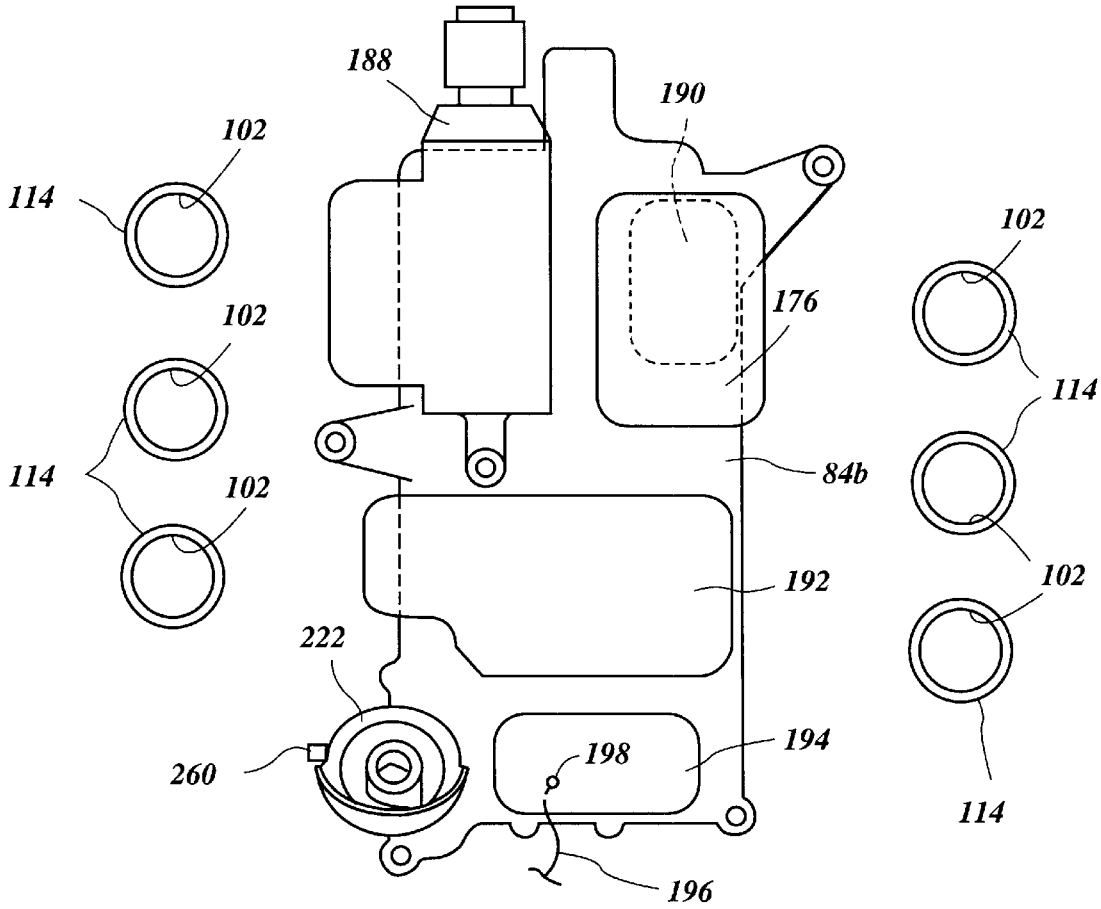
FIG. 12 is a schematic front view showing arrangements of the crankcase cover, the intake passages and the electrical components.

In the illustrated embodiment, the engine 32 has a port or manifold fuel injection system, although other conventional fuel supply and charge forming systems, such as, for example, a direct injection fuel system or carburetors, can be applied. The fuel injection system of the illustrated embodiment includes six fuel injectors. 174, each injector associated with a respective one of the combustion chambers 82. The fuel injectors 174 have injection nozzles directed toward the respective intake passages 102 adjacent to the intake ports 100. The fuel injectors 174 spray fuel into the intake passages 102 under a control of an ECU (Electronic Control Unit) 176 (FIG. 12). More specifically, the ECU 176 controls the fuel amount delivered by and the timing of each injection. Fuel rails, which are affixed to the throttle bodies 112, support the fuel injectors 174.

The fuel injection system further includes a fuel supply tank that is placed in the hull of the associated watercraft 42 to contain fuel that will be sprayed by the fuel injectors 174. Fuel is drawn from the fuel tank through a fuel supply passage by a low-pressure fuel pump and supplied to a fuel reservoir or fuel vapor separator 178.

As seen in FIGS. 2 and 3, the vapor separator 178 is generally disposed in a space defined between the port side surface of the crankcase assembly 84 and the intake runners 114. At the end of the supply passage to the vapor separator 178, a float valve is provided that is operated by a float so as to maintain a generally uniform level of the fuel in the vapor separator 178. A high-pressure fuel pump is placed in the vapor separator 178 and pressurizes the fuel that is delivered to the fuel injectors 174 through a fuel delivery passage that includes the fuel rail. The high-pressure fuel pump preferably is an electric pump that is driven by an electric motor and develops a pressure greater than the pressure developed by the low-pressure fuel pump 174.

A fuel return passage connects a portion of the fuel delivery passage to the vapor separator 178 to return excess fuel thereto. A pressure regulator is positioned in the return passage and limits the pressure that is delivered to the fuel injectors 174 to a preset and fixed magnitude by dumping the fuel back to the vapor separator 178 when the pressure in the fuel rail is greater than the preset magnitude. Because the pressure regulator keeps the pressure at this constant magnitude, the ECU 176 controls the duration of each injection so as to control the amount of the fuel injected.

The engine 32 further includes an ignition or firing system. In the illustrated embodiment, three spark plugs 180 are mounted on each cylinder head member 80 so as to each expose their electrodes to the associated combustion chambers 82. The spark plugs 180 fire air/fuel charges in the combustion chambers 82 at each proper timing. The ECU 176 also controls the firing timing. The air/fuel charge is formed with the air supplied by the air induction system 98 and the fuel sprayed by the fuel injectors 174 of the fuel injection system.

A flywheel assembly 184 is affixed atop the crankshaft 88. The flywheel assembly 184 includes a generator to supply electric power to the firing system, to the ECU 176 and to other electrical components via a battery 186 and/or directly.

As seen in FIG. 1, the battery 186 is disposed in the hull of the watercraft 42. As seen in FIGS. 3, 9, 12 and 21, the electrical components include a starter motor 188, a rectifier regulator 190, a relay box 192 containing various relay elements 192*a* and a fuse box 194 containing fuses 194*a*. The starter motor 188 drives the crankshaft 88 for starting the engine 32. The rectifier regulator 190 converts AC current to DC current and keeps a constant voltage.

As seen in FIG. 3, these electrical components 188, 190, 192, 194 are disposed in a space defined between the crankcase assembly 84 and the plenum chamber members 116 and are affixed to the crankcase cover 84*b*. In the illustrated embodiment, the ECU 176, the starter motor 188 and the rectifier regulator 190 are positioned at an upper portion of the crankcase cover 84*b*. The ECU 176 and the rectifier regulator 190 are placed in parallel to the starter motor 188, and the regulator 190 is disposed below of the ECU 176. The relay box 192 is positioned at a middle portion and the fuse box 194 is positioned under the relay box 192. This arrangement is advantageous because not only can the space between the crankcase assembly 84 and the plenum chamber members 116 be effectively used, but also because the electrical components 188, 190, 192, 194 can be well protected by the plenum chamber members 116 particularly when the top cowling member 62 is detached.

The arrangement described above, however, merely exemplifies one suitable construction and any other arrangements are practicable. Also, other engine-related components can be placed in this space.

Figure 21:
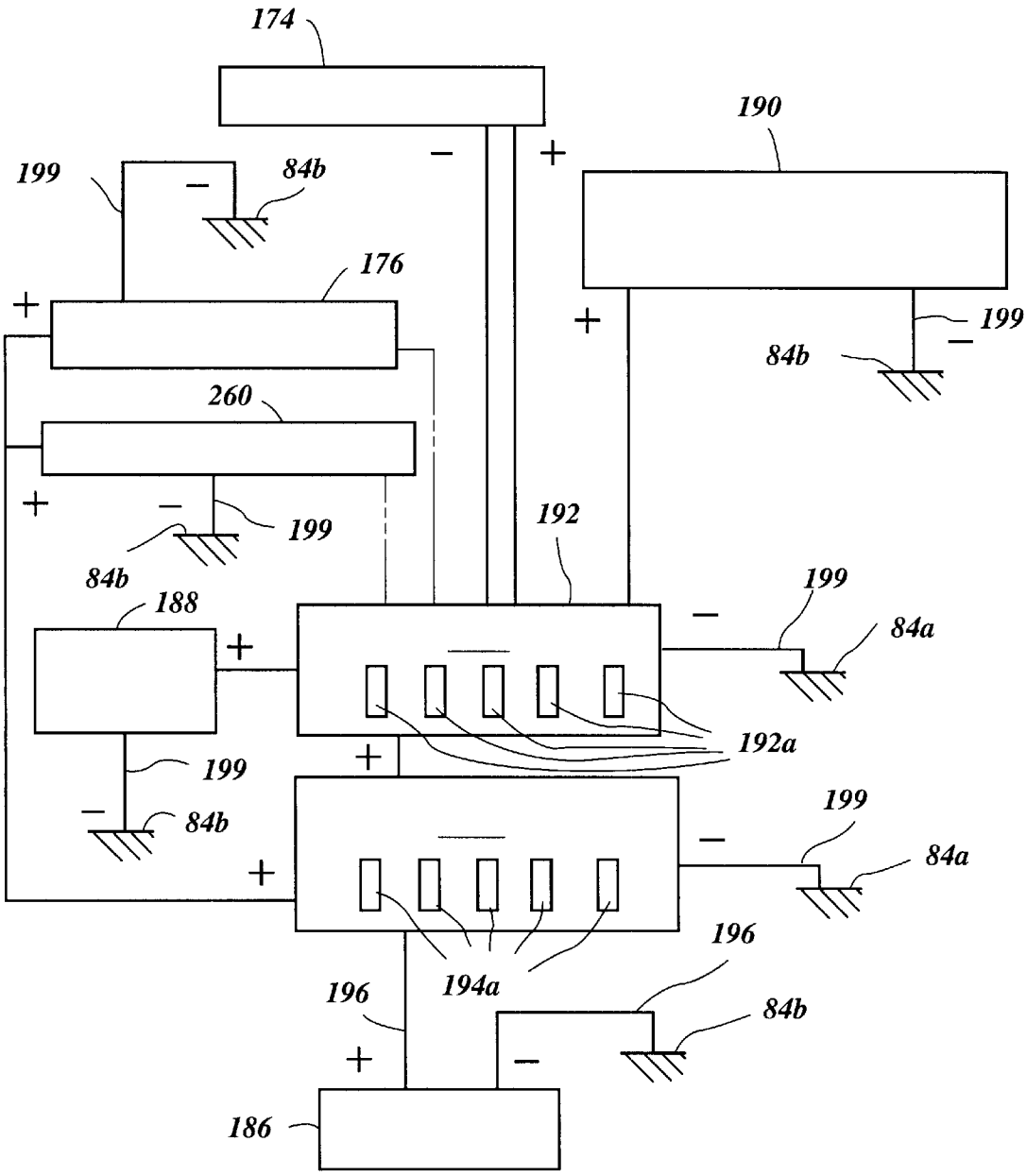
FIG. 21 is a diagrammatic view showing a wiring outline of electrical components.

In the illustrated embodiment, as seen in FIGS. 1, 12 and 21, the battery 186 is grounded to the engine body at the crankcase cover 84*b*. That is, a ground line 196 of the battery 186 is connected to a portion 198 of the crankcase cover 84*b*. Because of this, the electrical components 176, 188, 190, 192, 194 can be easily grounded by connecting their ground lines 199 to the crankcase cover 84*b*. Electrical lines including the ground line 196 are generally disposed in the space defined between the engine body 96 and an inner surface of the upper cowling 62.

The engine 32 also includes a lubrication system. A lubricant reservoir or oil pan 200 depends from the exhaust guide member 68 into the driveshaft housing 56 and contains lubricant oil. The lubricant reservoir 200 in this embodiment is generally configured as a doughnut shape in section. A suction pipe 202 is provided in the lubricant reservoir 200 to connect the reservoir 200 to an oil pump unit 204. The suction pipe 202 has a port at almost the bottom position of the lubricant reservoir 200. An oil strainer 206 is provided at the port for removing foreign substances from the lubricant oil.

The crankshaft 88 drives the oil pump unit 204 of the lubrication system. The lubricant in the lubricant reservoir 200 is drawn by this oil pump unit 204 and is delivered to engine portions that need lubrication. The oil pump unit 204 is disposed at the bottom of the engine 32. As best seen in FIG. 5, the oil pump unit 204 has an inlet port 210 and an outlet port 212. The inlet port 210 communicates with the suction pipe 202 through a suction passage 214, while the outlet port 212 communicates with the engine portions through a delivery passage 216. The suction passage 214 is defined in the exhaust guide member 68 and the cylinder block 74, while the delivery passage 216 is defined in the cylinder block 74. A construction of the oil pump unit 204 will be described in detail shortly.

Figure 6:
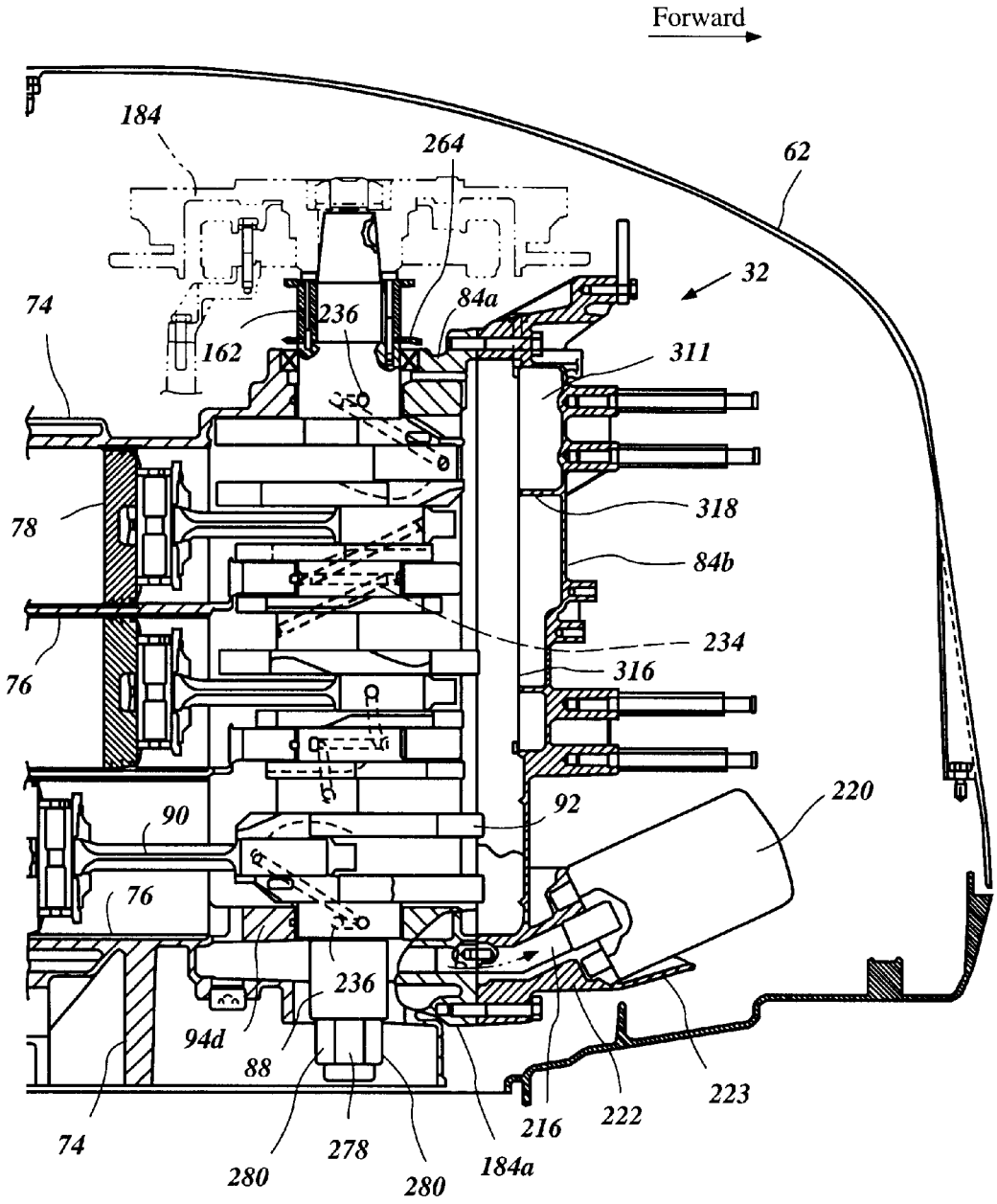
FIG. 6 is a sectional side view of a portion of the engine generally taken along a vertical plane including a line extending through cylinder bores on one bank, a crankcase member and a crankcase cover. The oil pump unit and a baffle plate are omitted.

The engine portions that need lubrication include, for example, crankshaft bearing portions 218 where the bearing blocks 94*a*, 94*b*, 94*c*, 94*d* support the crankshaft 88. As best seen in FIGS. 6 and 11, an oil filter 220 is detachably affixed to a mounting boss 222 formed at a bottom portion of the crankcase cover 84*b* to remove further foreign substances from the lubricant. The oil filter 220 generally has a cylindrical shape. The mounting boss has a guide portion 223 that can temporarily support and guide the body of the oil filter 220 when the filter 220 is attached to the mounting boss 222. As best seen in FIG. 6, the oil filter 220 is obliquely mounted onto the mounting boss 222. Because of this, even though the oil filter 220 is positioned at the bottom portion of the crankcase cover 84*b*, it can be easily placed onto or removed from the mounting boss 222.

The delivery passage 216 communicates with the oil filter 220. The oil filter 220, in turn, communicates with a supply passage 224 (FIG. 5) and then with a main gallery 226 (FIGS. 3, 4, 11 and 14), both defined in the cylinder block 74. A closure member 230 closes the top portion of the main gallery 226. The lubricant is then supplied to the respective bearing portions through branch passages defined within the bearing blocks 94*a*, 94*b*, 94*c*, 94*d*. After the lubrication has been delivered to the bearing blocks, the lubricant drops to the bottom of the crankcase chamber 86 due to its own weight (i.e., under gravity).

The engine portions that need lubrication further include portions where the connecting rods 90 are coupled with the crankshaft 88 and where they are coupled with the pistons 78. The pistons 78 furiously reciprocate within the cylinder bores 76 and thus the pistons 78 also need the lubrication. Some of the lubricant is delivered to those portions through drilled passages 234 in the crankshaft 88 and in the connecting rods 90. Inlet ports 236 are opened at certain portions of the crankshaft 88. The lubricant, after lubricating these portions, also falls to the bottom of the crankcase chamber 86.

The pistons 78 need lubrication so as not to seize on surfaces of the cylinder bores 76. One or more through-holes are made at each skirt portion of the piston 78 and hence the lubricant oil can move out to the outer surface of the piston 78 which slides along the surface of the cylinder bore 76. Piston rings are provided on and around the pistons 78 primarily to isolate the combustion chambers 82 from the crankcase chamber 86. At least one piston ring, which is normally placed at the lowermost position, can remove the lubricant from the surface of the cylinder bore 76 to the crankcase chamber 86.

The engine portions that need lubrication further include the camshaft bearing portions. Lubricant delivery arrangements for the camshaft bearing portions are similar to the arrangement describe above.

The lubricant that has dropped to the crankcase chamber 86 returns to the lubricant reservoir 200 through a return passage. The lubricant oil that has returned to the lubricant reservoir 200 is recycled so as to lubricate the same engine portions repeatedly.

As best seen in FIG. 11, the lubrication system has a lubricant replenishment pipe 240 affixed to a side surface of the crankcase cover 84*b*. A cap 242 closes an inlet port atop the pipe 240.

Figure 13:
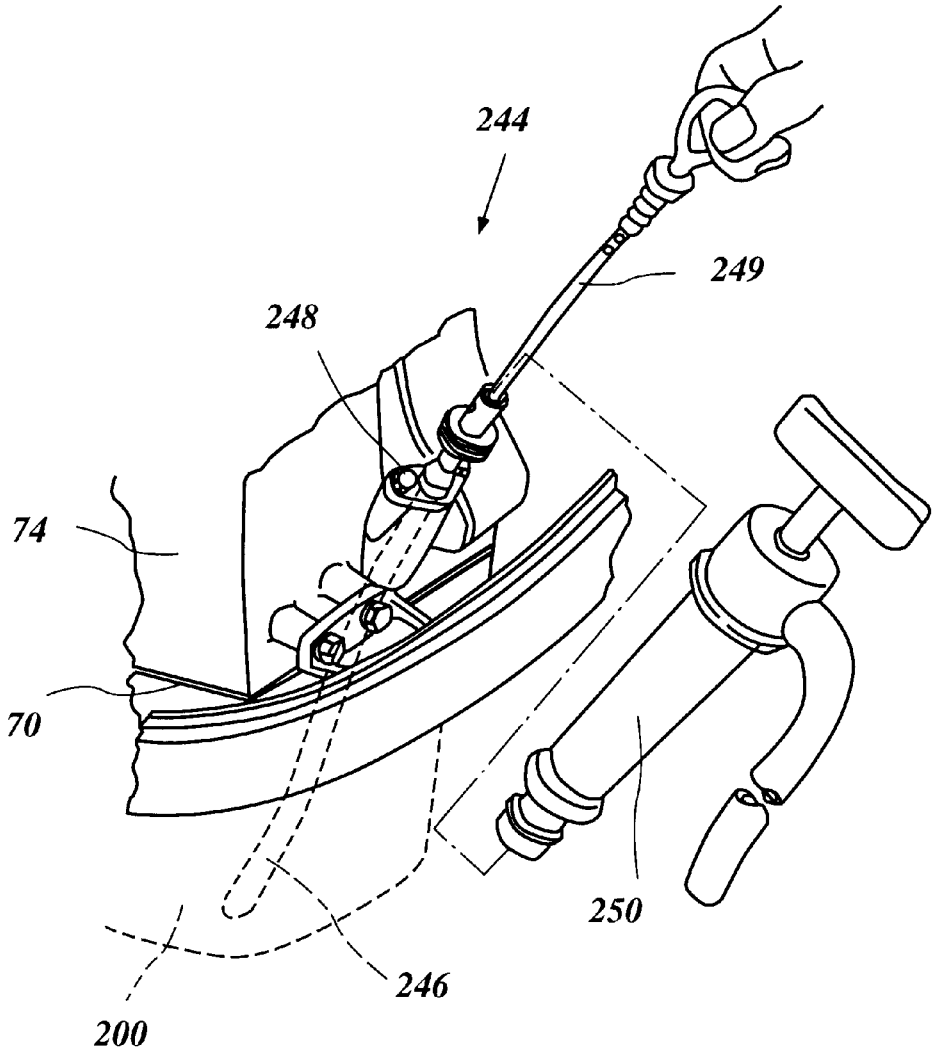
FIG. 13 is a perspective side view showing a portion of the cylinder block where an oil dipstick is positioned.

The lubrication system further has a level gauge unit 244 including a guide pipe 246, which are a rigid pipe, and an oil dipstick 248. As best seen in FIG. 13, the guide pipe 246 passes through an opening formed at a bottom portion of the cylinder block 74 and its top portion is detachably affixed to the portion of the cylinder block 74 by a bolt 249. The lowermost portion of the guide pipe 246 reaches a proximity to the bottom of the lubricant reservoir 200. The dipstick 248 is normally inserted into the guide pipe 246. The operator or user of the outboard motor 30 can take the dipstick 248 out of the guide pipe 246 to check an amount of the lubricant and/or a condition of the lubricant (i.e., whether it is dirty or clean). If the operator replaces the dipstick 248 with an oil remover pump 250, the lubricant in the reservoir 200 can be removed therefrom.

The engine 32 further has a water-cooling system that provides cooling water to engine portions, for example, the cylinder block 74 and the cylinder head member 80 because they get quite hot during engine operations. For instance, water jackets 256 (FIG. 4) are formed within the cylinder block 74 and the cylinder head member 80. The water is also supplied to the exhaust system 136. Cover members 258, as best seen in FIG. 3, are affixed to the exhaust members 142 also to define the water jackets 256 therebetween. The cooling water is introduced from the body of water surrounding the outboard motor 30 in a manner that is well known.

Additionally, the engine 32 in the illustrated embodiment has a number of engine related devices or components that are mounted onto the engine 32 or provided adjacently to the engine 32 other than the foregoing electrical components, i.e., the ECU 176, starter motor 188, rectifier regulator 190, relay box 192, fuse box 194. In the illustrated embodiment, for example, an oil pressure sensor 260 (FIGS. 12 and 21) is further provided on the crankcase cover 84*b* for sensing an oil pressure of the lubrication system. More specifically, if the oil pressure at, for example, the delivery passage 216 drops down below a preset value, the pressure sensor 260 outputs a signal so that the ECU 176 recognizes this abnormal situation. A crankshaft angle position sensor 262 (FIG. 5) is also provided atop the cylinder block 74 in the close proximity to a washer 264 affixed to the crankshaft 88. The washer 264 has notches around its outer periphery. The position sensor 262 is a proximity switch that generates signals when the notches approach thereto. The sensed signals by the oil pressure sensor 260 and the position sensor 262 are sent to the ECU 176 and are used, for example, for various engine controls.

With reference back to FIG. 1, the driveshaft housing 56 depends from the power head 54 and supports a driveshaft 270, which is driven by the crankshaft 88. The crankshaft 88 has a splined recess 271 (FIG. 5) at its bottom portion, while the driveshaft 270 has a splined top. The splined top of the driveshaft 270 is fitted into the splined recess 271 of the crankshaft 88 so that the driveshaft 270 is coupled with the crankshaft 88. The driveshaft 270 extends generally vertically through the exhaust guide member 68 and then extends through the driveshaft housing 56 in front of the lubricant reservoir 200.

The driveshaft housing 56 also defines internal passages that form portions of the exhaust system 136. In the illustrated embodiment, an exhaust pipe 272 depends from the exhaust guide member 68 and extends downwardly through a center hollow of the lubricant reservoir 200. An upper portion of the exhaust pipe 272 communicates with the exhaust passage 72 defined in the exhaust guide member 68. An exhaust expansion chamber depends from a bottom of the lubricant reservoir 200. A lower portion of the exhaust pipe 272 communicates with the expansion chamber. The expansion chamber has a relatively large capacity so that the exhaust gases expand there to lose energy and silence exhaust noise. An idle exhaust passage branches off from one of the internal passages and opens to the atmosphere above the body of water.

With reference to FIGS. 1, 5 and 6, the construction of the oil pump unit 204 will now be described below. The oil pump unit 204 is defined at the bottom portion of the cylinder block 74 and the crankcase member 84*a* where the driveshaft 270 is coupled with the crankshaft 88. In the illustrated embodiment, the oil pump unit 204 defines a rotary or trochoid pump. This type of pump, however, is merely exemplary of a type that can be used with the lubrication system. Other types of pumps such as, for example, a gear pump, are applicable.

An upper housing member 273 is affixed to the bottom of the cylinder block 74 and the crankcase member 84*a* by bolts 274. The upper housing member 272 has a cylindrical portion 275 fitted into a recessed portion defined by the cylinder block 74 and the crankcase member 84*a*. The cylindrical portion 275 defines an opening through which the crankshaft 88 extends. An upper oil seal member 276 is provided between an outer surface of the crankshaft 88 and an inner surface of the upper housing member 272 for preventing the lubricant in the oil pump unit 204 from leaking out. The foregoing inlet port 210 and the outlet port 212 are formed at the upper housing member 272. The upper housing member 272 preferably is made of metal or plastic.

As seen in FIG. 6, the crankshaft 88 is cut away to define two flat surfaces 278 extend in parallel to each other. The other surfaces 280 of the crankshaft between the flats 278 hold arcuate configurations. An inner rotor 282, which has a recess that is conversely configured relative to the outer configuration of the crankshaft 88, is fitted onto the crankshaft 88 via a drive collar or bush member 284. An outer rotor 286 then meshes with the inner rotor 282. The inner and outer rotors 282, 286 together form a pumping assembly.

It should be noted that the drive collar 284 is dispensable. In this variation, the inner rotor 282 is directly coupled with the crankshaft 88.

A lower housing member 288 is affixed to the lower surface of the upper housing member 272 so as to define a pump cavity with the upper housing member 272 in which the inner and outer rotors 282, 286 are disposed. In the illustrated embodiment, the lower housing member 288 is defined by a single piece. The lower housing member 288 has an opening through which both the crankshaft 88 and the driveshaft 270 extend. The bolts 274 are used in this embodiment to fix the lower housing member 288 to the upper housing member. An inlet passage 290 and an outlet passage 292 are defined between the upper housing member 272 and the lower housing member 288. The inlet passage 290 communicates with the inlet port 210, while the outlet passage 292 communicates with the outlet port 212. The lower housing member 288 preferably is made of metal or plastic.

A lower oil seal member 294 is provided between another outer surface of the crankshaft 88 and an inner surface of the lower housing member 288. A water seal member 296 is further provided between a surface of the driveshaft 270 and another inner surface of the lower housing member 288. The lower oil seal member 294 inhibits the lubricant oil in the oil pump unit 204 from leaking out from the oil pump unit 214, while the water seal member 296 inhibits water or water mist around the coupling portion from contacting the coupling portion.

In the illustrated embodiment, the crankshaft 88 actually defines three sections having different diameters. An upper section is larger than a middle section, and the middle section is larger than a lower section. The upper oil seal member 276 is positioned at the upper section. The inner and outer rotors 282, 286 are positioned at the middle section. The lower oil seal member 296 is positioned at the lower section.

With rotation of the crankshaft 88, the crankshaft 88 drives the inner rotor 282 via the drive collar 284. Because the outer rotor 286 meshes with the inner rotor 282, the outer rotor 286 also rotates with the inner rotor 282. A space, which is defined between the inner and outer rotors 282, 286, communicates with the inlet passage 290 and the outlet passage 292, and changes its volume with the rotation of the inner and outer rotors 282, 286. The oil in the space is thus drawn into the space from the inlet passage 290 and then pushed out to the outlet passage 292.

Because the lower oil seal member 294 inhibits the oil in the housing members 272, 288 from leaking, the oil cannot accumulate at the coupling portion of the driveshaft 270 with the crankshaft 88 and hence will not deteriorate.

In addition, the lower oil seal member 294 faces the outer surface of the crankshaft 88 without having something such as a sleeve lie therebetween. This outer surface of the crankshaft 88 therefore can be simultaneously machined with other portions that need to be machined. The construction thus does not require an additional manufacturing step, unlike conventional constructions.

With reference to FIG. 1 again, the lower unit 58 depends from the driveshaft housing 56 and supports a propulsion shaft 300 that is driven by the driveshaft 270. The propulsion shaft 300 extends generally horizontally through the lower unit 58. In the illustrated embodiment, the propulsion device supports a propeller 302 that is affixed to an outer end of the propulsion shaft and is driven thereby. The propulsion device, however, can take the form of a dual, a counter-rotating propeller system, a hydrodynamic jet, or like propulsion devices.

A transmission 304 is provided between the driveshaft 270 and the propulsion shaft 300. The transmission 304 couples together the two shafts 270, 300 that lie generally normal to each other (i.e., at a 90° shaft angle) with a bevel gear train or the like. The transmission 304 has a switchover or clutch mechanism to shift rotational directions of the propeller 302 between forward, neutral or reverse. The switchover mechanism is operated by the operator through a shift linkage including a shift cam, a shift rod, a coupling rod 306 and a shift cable 308 (FIG. 9). The shift cable 308 extends toward the watercraft 42 along with the throttle cable 128.

The lower unit 58 also defines an internal passage that forms a discharge section of the exhaust system 136. An upper portion of this internal passage connects to the expansion chamber in the driveshaft housing 56. At engine speeds above idle, the majority of the exhaust gases are discharged toward the body of water through the internal passage and a hub of the propeller 302. At idle, the exhaust gases are mainly discharged through the idle exhaust passage because the exhaust pressure under this condition is less than the backpressure created by the body of water.

With reference to FIGS. 3, 4, 10 and 11, the crankcase assembly 84 and the crankcase chamber 86 will now be described in greater detail below. In the illustrated embodiment, a baffle plate 310 is affixed to the crankcase member 84*a* to divide the crankcase chamber 86 into a primary chamber 86*a* and a secondary chamber 86*b*, although both the chambers 86*a*, 86*b* communicate with each other through a plurality of slits or through-holes 312 (FIG. 11) and spaces defined at both sides of the baffle plate 310. The primary chamber 86*a* has a larger capacity than the secondary chamber 86*b* and the crankshaft 88 exists in the primary chamber 86*a*. Also, the baffle plate 310 bulges out toward the secondary chamber 86*b*.

Part of the lubricant oil, after lubricating the respective engine portions, hangs in the air of the primary chamber 86*a* as mist or vapor. This lubricant mist tends not to drop down to the lubricant reservoir 200 because the rotation of the crankshaft 88 swirls the mist furiously. The lubricant, however, preferably returns to the lubricant reservoir 200 as soon as possible so as to be reused.

The baffle plate 310 is advantageous for returning the lubricant quickly to the reservoir 200. The lubricant mist moves into the secondary chamber 86*b* through the slits 312 in the plate 310 and spaces defined at both sides thereof. Once it has moved to the secondary chamber 86*b*, the mist soon condenses to a liquid state lubricant by adhering t surfaces of the baffle plate 310 and an inner surface of the crankcase cover 84*b*. The rotational movement of the crankshaft 88 does not significantly influence the mist in this secondary chamber 86*b*. The liquid lubricant thus drops to the bottom of the lubricant reservoir 200 along the surfaces of the baffle plate 310 and the crankcase cover 84*b*.

The baffle plate 310 is also useful for preventing the lubricant from splashing onto the crankshaft 88 during a replenishment of the lubricant because the crankshaft 88 is positioned in the primary chamber 86*a* that is separated from the secondary chamber 86*b* into which the lubricant is introduced through the lubricant replenishment pipe 240.

The lubricant mist in the primary chamber 86*a* also includes blow-by gases. The blow-by gases comprise unburnt charges and a small amount of exhaust gases that have passed from the combustion chambers 82. Although the combustion chambers 82 are isolated by the piston rings as noted above, those gases can leak to the crankcase chamber 86 because of large expansion pressure generated in the combustion chambers 82.

In order to remove the blow-by gases and oil vapors that remain still in the secondary chamber 86*b*, a ventilation system is provided in the engine 32 of this embodiment. The ventilation system comprises a breather chamber or oil separator 311 and a breather pipe 312.

Figure 10:
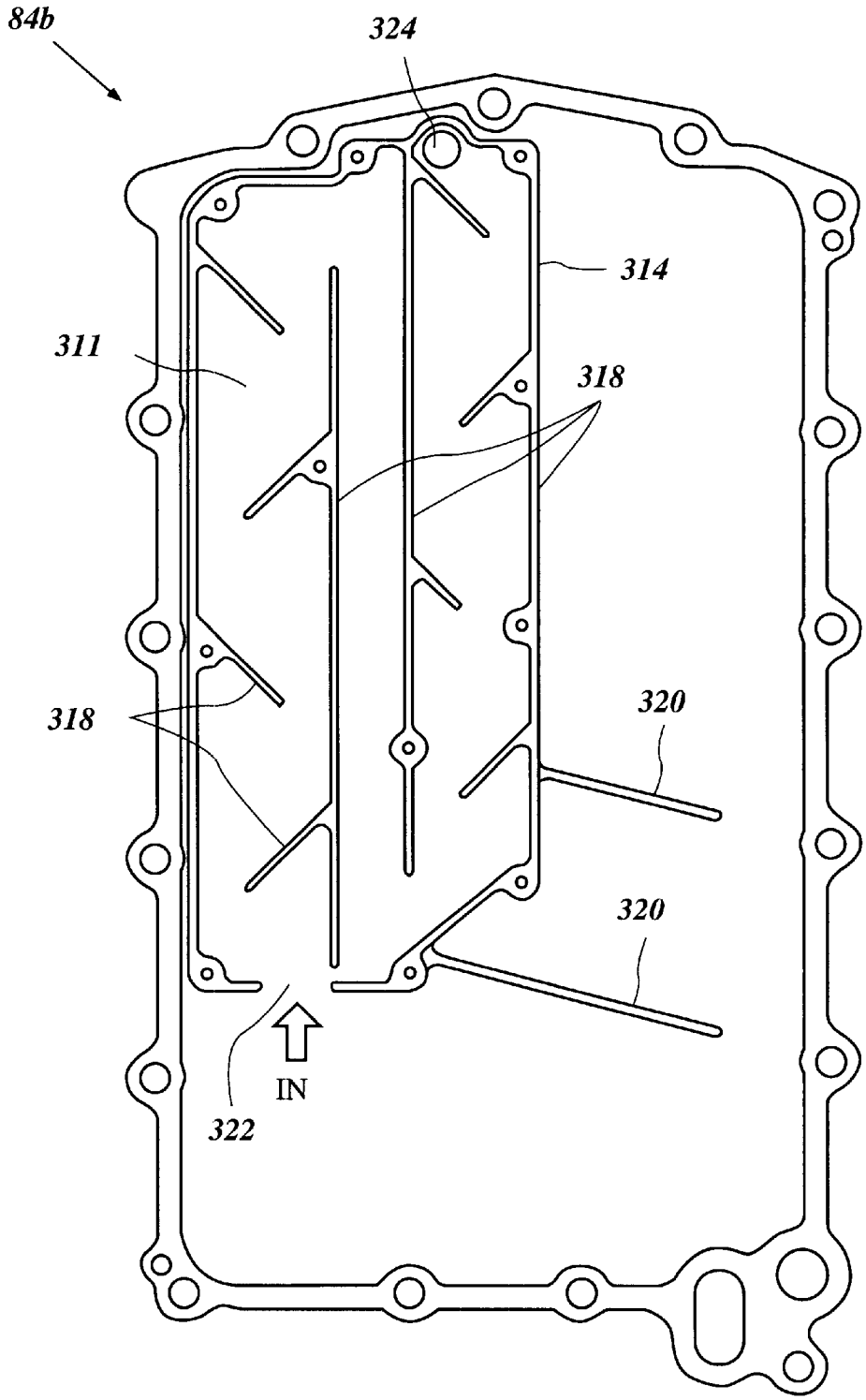
FIG. 10 is a rear view of the crankcase cover.

As best seen in FIGS. 6 and 10, the breather chamber 311 is defined by an inner surface of the crankcase cover 84*b*, a rampart 314 that extends from the inner surface of the crankcase cover 84*b* and a lid plate 316 affixed to the rampart 314. A plurality of baffle projections 318 also extends from the inner surface of the crankcase cover 84*b* so that a labyrinth structure is formed within the breather chamber 311. The baffle projections 318 are generally directed downwardly. Additionally, other baffle projections 320 are provided out of the breather chamber 311 in the same manner.

An inlet port 322 of the breather chamber 311 opens downwardly at its bottom portion, while an outlet port 324 thereof, which is a through-hole, opens atop the breather chamber 311 and also atop of the crankcase cover 84*b*.

As best seen in FIG. 4, the breather pipe 312 couples the breather chamber 311 with one or both of the plenum chambers 104. In the illustrated embodiment, the plenum chamber member 116 which is disposed on the port side has an inlet port 326, and the breather pipe 312 connects the outlet port 324 of the breather chamber 311 to the inlet port 326 of this plenum chamber member 116.

The oil vapors or mist, including the blow-by gases, are introduced into the breather chamber 311 through the inlet port 322 because as the air in the plenum chamber 104 is drawn to the combustion chambers 82 during engine operations the breather chamber 311 is depressurized. The baffle projections 320 formed in the breather chamber 311 inhibit the oil vapors from passing to other portions in the crankcase cover 84. The oil vapors introduced into the breather chamber 311 are directed to the outlet port 324 through the labyrinth structure. Because the baffle projections 318 prevent the oil vapors from flowing directly and smoothly, the lubricant component of the vapors condense and thus are separated from gases. The liquid oil then drops down to the lubricant reservoir 200 and only the gases pass through the outlet port 324. The gases then move to the plenum chamber 104 through the breather pipe 312 and further to the combustion chambers 82 through the intake passages 102. Once the gases reach the combustion chambers 82, they are burned therein with the air/fuel charges that have been simultaneously supplied to the combustion chambers 82.

Because the breather chamber 311 is positioned in the close proximity to the plenum chamber 104 in this embodiment, the length of the breather pipe 312 can be short so as to simplify the engine layout.

With reference to FIGS. 1 to 4, 7 and 9, the air induction system 98, particularly the plenum chamber members 116, will now be described in greater detail below. As best seen in FIGS. 2 to 4, in the illustrated embodiment, both the plenum chamber members 116 are generally disposed on the front side of the engine. The plenum chamber members 116 are positioned in close vicinity to each other. The engine 32 has a center line C (FIG. 4) extending through both the cylinder block 74 and the crankcase assembly 84. The plenum chamber members 116 are spaced apart from each other so as to exist on both sides of the center line C. As best seen in FIG. 4, the crankcase assembly 84 in this embodiment has a surface extending generally normal to the center line C, although the surface has irregularities. Both the plenum chamber members 116 face to the surface. The throttle bodies 112 have axes extending generally in parallel to the center line C. Although the intake runners 114 curve toward the plenum chamber members 116, at least portions connected to the throttle bodies 112 also extends generally in parallel to the center line C.

The plenum chamber members 116 have air inlet ports 330 opening toward the crankcase assembly 84 and an axis of each inlet port 330 extends generally in parallel to the center line. That is, the air inlet ports 330 face to the electrical components 176, 188, 190 192, 194 placed between the crankcase assembly 84 and the plenum chamber members 116. The air in the closed cavity 61 of the cowling assembly 60 is introduced into the plenum chambers 104 through the inlet ports 330 without interfering with each other. Before entering, the air flows around the electrical components 176, 188, 190 192, 194. The electrical components 176, 188, 190 192, 194 may be warmed during their operations. The airflow over these components cools them.

As best seen in FIGS. 4 and 7, a balance pipe 332 couples both the plenum chambers 104 together. The balance pipe 332 is a relatively small pipe (in comparison to the cross-sectional flow size of the plenum chambers) to balance or equalize the air intake pressure within the respective plenum chambers 104. The pipe 332 is generally configured as a U-shape and has a passage portion 334 and a pair of connecting portions 336. Each plenum chamber member 116 has a recess 340 at its forward portion. The recesses 340 of the respective plenum chamber members 116 are generally sequentially formed with the other one that is defined at the other plenum chamber member 116. A hollow coupling projection 342 extends from each of the plenum chamber member 116 at the recess 340. The connecting portions 336 are fitted into the respective coupling projections 342 to complete the communication of the plenum chambers 104 with each other. When the connecting portions 336 are coupled with the projections 342, outer forward surfaces of the plenum chamber members 116 and an outer surface of the pipe 332 together define an even surface. That is, the pipe 332 is generally completely fitted in the recesses 340 and does not project from the forward surface of the plenum chamber members.

Figure 8:
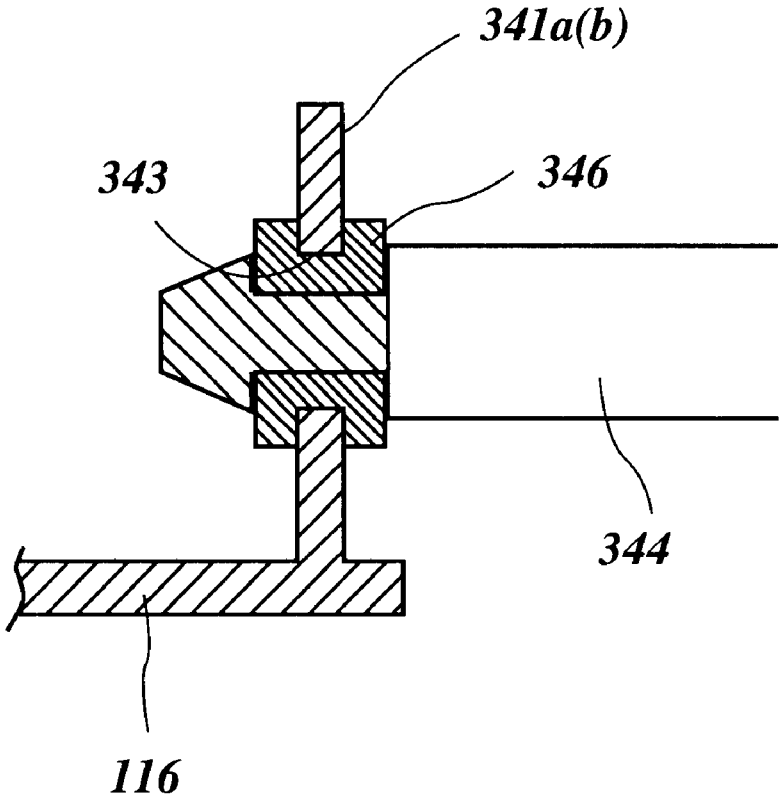
FIG. 8 is a sectional view of a one-touch fastener including a rod member and a grommet.

With primary reference to FIGS. 4, 7 and 8, a mount construction of the intake units 118 will now be described. The plenum chamber member 116 of the intake units 118, which is disposed on the port side, has a pair of projections 341*a* that extend transversely toward the opposite side of the other intake unit 118 on the starboard side and spaced apart vertically from each other. The projections 341*a* define through-holes 343 (FIG. 8). The plenum chamber member 116 on the starboard side, in turn, has also a pair of projections 341*b* extending transversely toward the other intake unit 118 on the port side and spaced apart vertically from each other. Four rod members 344, each of which has a hexagonal shape in section, are screwed down to the crankcase cover 84*b* at appropriate locations so that the intake units 118 can be placed as described above. An axis of each rod member 344, when it is screwed down to the crankcase cover 84*b*, extends generally in parallel to the center line C. As best seen in FIG. 8, a tip portion of each rod member 344 is cut circularly and a rubber grommet 346 is fitted into the circular recess. The grommets 346 of the respective rod members 344 are then fitted into the through-holes 343. The rod members 344 and the grommets 346 define one-touch fasteners.

The rear end portions 348 of the intake runners 114 of the intake units 118 are connected to the front end portions 350 of the throttle bodies 112 via rubber sealing members 352, which is shaped as a ring. As seen in FIG. 4, the sealing member 352 is detachably fitted onto the front end portions 350 of the throttle bodies 112 and then the rear end portions 348 of the intake runners 114 are detachably fitted into the sealing members 352 so as to complete air tight connections of the respective throttle bodies 112 and the intake runners 114.

When assembling the intake units 118 with the engine 32, the respective intake runners 114 are connected to the respective throttle bodies 112 via the sealing members 352. The rod members 344, which have been already screwed down to the crankcase cover 84*b*, are then fitted into the grommets 346, which have been also put at the projections 341*b* of the plenum chamber members 116. The breather pipe 312 is also fixed to the outlet port 324 of the breather chamber 311 and the inlet port 326 of the plenum chamber 104. Finally, the connecting portions 336 of the balance pipe 332 are affixed to the respective coupling projections 342 of the plenum chamber members 116 so that the passage portion 334 of the conduit 332 is fitted into the recesses 340.

As described above, in the illustrated embodiment, the plenum chambers 104 are disposed on the front of the engine. In addition, the plenum chamber members 116 are positioned in close vicinity to each other. The air induction system 98 can thus have the intake passages 102 with lengths as long as possible. This arrangement is advantageous for low speed running conditions.

The engine 32 in this embodiment has the multiple plenum chambers 104 rather than a single plenum chamber. The respective plenum chambers 104 are required to be coupled with only the intake passages 102 on one side of the engine because the balance pipe 332 can couples the plenum chambers 104 together. The arrangement thus is easily assembled even though the related components have relatively rough accuracy in their configurations and mount positions on the engine.

While in the illustrated embodiment each plenum chamber member 116 is unified with the corresponding intake runners, it is understood that the plenum chamber members and the respective intake runners can be separate components that are fitted together. In addition, each set of intake runners can be unitary or be formed from separate components.

Because the crankcase cover 84*b* in the embodiment has not only the breather chamber 311 defined therein but also the electrical components 176, 188, 190, 192 and 194 affixed thereto, the crankcase assembly 84 preferably is reinforced to inhibit deformation due to these loadings.

Figure 14:
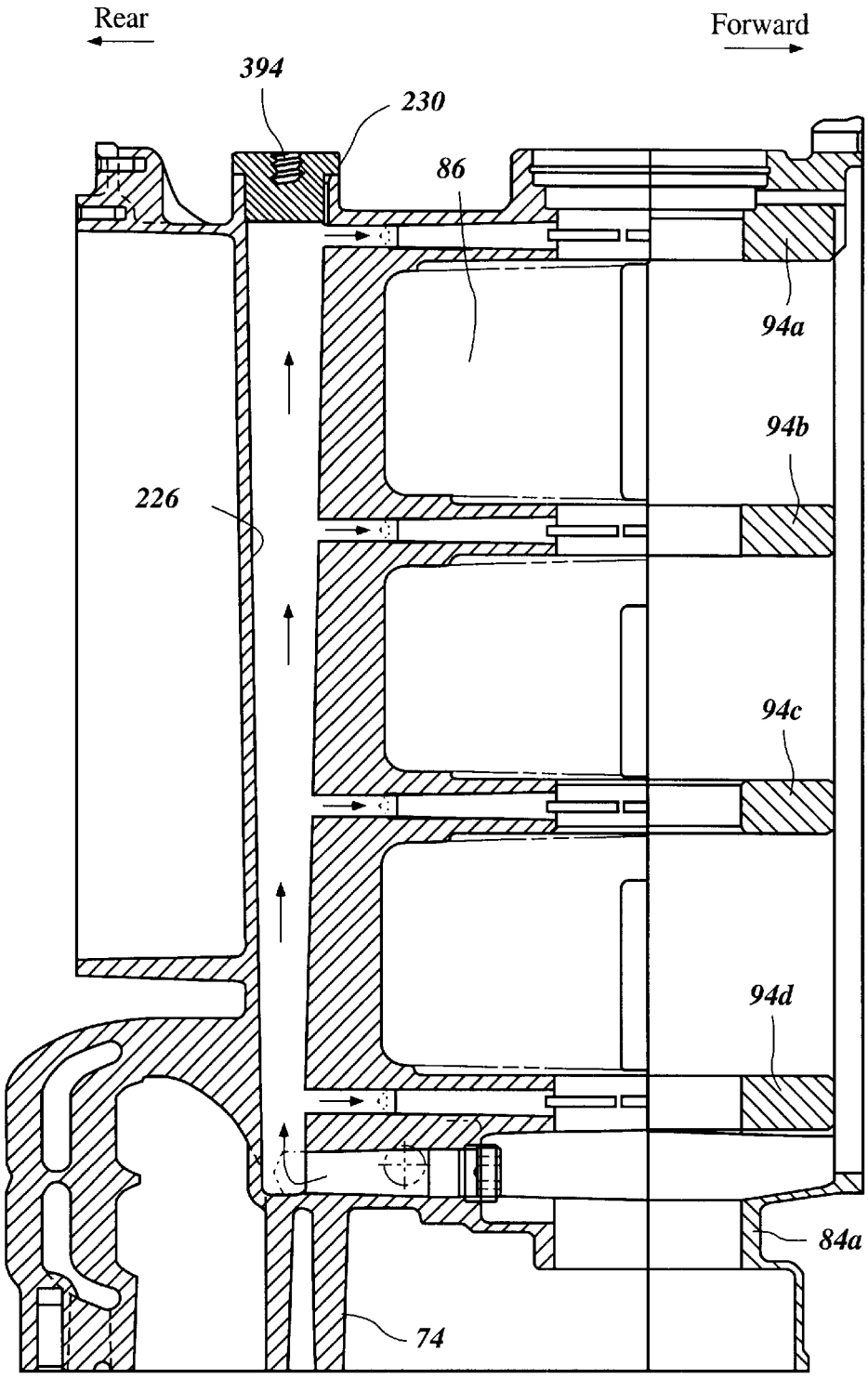
FIG. 14 is a sectional side view of a portion of the engine generally taken along a vertical plane including a center line extending through a main lubricant gallery, the cylinder block, the crankcase member and the crankcase cover.

With primary reference to FIGS. 9 and 14–20, the throttle valve linkage 126 will now be described in great detail below. The valve shaft 124 on each bank has a valve lever 380, 382 positioned atop the valve shaft 124 and rigidly affixed thereto. The valve lever 380 on the starboard side cylinder bank has a lever portion 380*a*, while the other valve lever 382 on the port side has also a lever portion 382*a* which is slightly longer than the lever portion 380*a*. A manipulator or valve actuator 384, which is used for manipulation of the valve levers 380, 382, is pivotally affixed to the foregoing closure member 230. More specifically, a ring member 386 is fitted into a bottom recess of the manipulator 384 and is prevented from coming out by a snap ring 388. A bushing or collar 390 is affixed to the closure member 230 by a pin 392. The ring member 386 of the manipulator 384 is fitted onto the bushing 390. As best seen in FIG. 14, the closure member 230 defines a threaded recess 394. A bolt 396 is screwed down to the threaded recess 394 with the manipulator 384, which has the ring member 386, and the bushing 390 both being interposed therebetween. Because the ring member 386 is thus pivotally mounted on the bushing 390, the manipulator 384 is pivotable about a pivot axis extending vertically through the closure member 230.

The manipulator 384 can be directly affixed to the cylinder block 74. Placing the manipulator 384 on the closure member 230 is, however, advantageous because no machining process to the cumbersome cylinder block 384 is necessary. Only the closure member 230, which is much smaller than the cylinder block 384, needs machining. Also, using the closure member 230 can save manufacturing cost rather than preparing another special component for affixing the manipulator 384 to the engine.

The manipulator 384 has two lever portions 384*a*, 384*b* which extend radially from the pivot axis of the manipulator 384 and are spaced apart from each other at a fixed angle. The lever portion 384*a* is larger than the other lever portion 384*b*. A coupling rod assembly 400 pivotally couples the lever portion 380*a* of the valve lever 380 with the lever portion 384*a* of the manipulator 384 via an adjustment mechanism 402, which will be described shortly. Another coupling rod assembly 404 directly and pivotally couples the lever portion 382*a* of the lever 382 with the lever portion 384*b* of the manipulator 384. In the illustrated embodiment, the coupling rod assemblies 400, 402 define manipulating members.

Each rod assembly 400, 404 includes a rod member 406, a pair of coupling members 408 and a pair of nuts 410. Both ends of the rod members 406 are threaded, while each coupling member has a hollow into which each threaded end of the coupling members 408 can be fitted. The nuts 410 are screwed onto the threaded portions before these ends are inserted into the hollows. After the threaded ends are inserted into the hollows, positions of the respective nuts 410 are adjusted so as to change the effective length of the rod assembly 400, 404. Fastening members 412, which have threaded end portions, are used for pivotal connection of the respective lever portions 382*a*, 384*a*, 384*b* or the adjustment mechanism 402 with the coupling members 408 of the rod assemblies 400, 404.

With reference to FIGS. 17–20, the adjustment mechanism 402 includes the valve lever 380 and an adjustment member 416. The valve lever 380 has two through-holes 418, 420, while the adjustment member 416 has three through-holes 422, 424, 426. The middle hole 424 of the adjustment member 416 defines a slit. The valve shaft 124 extends through the hole 418 of the valve lever 380 and the hole 422 of the adjustment member 416. The coupling member 408 of the rod assembly 400 is coupled with the adjustment member 416 by the bolt 412 that extends through the hole 426 of the adjustment member 416 and a through-hole of the coupling member 408. A screw 428 extends through the hole 420 of the valve lever 380 and the slit 424 of the adjustment member 416 and is locked by a lock member 430. Because the hole of the adjustment member 416 is formed as the slit 424, a position of the adjustment member 416 relative to the valve lever 380 is adjustable. If, therefore, the throttle valves 122 on both sides are not synchronize properly because of tolerances occurring in manufacturing or assembling processes or because of slop occurring because of wear, the operator can adjust this situation easily by changing the position of the adjustment member 416. That is, the adjustment mechanism 402 in this embodiment can adjust discrepancy in movement of throttle valves 122 on both banks so as to synchronize them accurately.

It should be noted that the hole 420 of the valve lever 380 can define a slit instead of the hole 424 of the adjustment member 416. In the illustrated embodiment, no adjustment mechanism is interposed between both the lever portions 382*a*, 384*b*. It is, however, practicable to provide another or an alternative adjustment mechanism therebetween.

With reference back to FIGS. 9, 15 and 16, the throttle valve linkage 126 also includes a control mechanism 440 that controls the manipulator 384. The control mechanism 440 generally comprises a mount body 442, a cam member 444, a cam follower 446, a vertical shaft 448, a horizontal bevel gear 450, a vertical bevel gear 452 and a control lever 454.

As seen in FIGS. 9 and 15, the mount body 442 is mounted on a starboard side surface of the engine body 96 by a bolt 458. The mount body 442 is positioned at the lowermost intake runner 114 and slightly forward of the lowermost throttle body 112. The mount body 442 is thus placed in a space defined between the lowermost intake runner 114 and the engine body 96.

The cam member 444 is pivotally affixed to the mount body 442 by a bolt 460. The throttle cable 128 is connected to a bottom end projection 461 of the cam member 444 through a connecting rod 461 so that the cam member 444 can pivot about an axis extending horizontally, which is the same as an axis of the bolt 460, when the operator operates the throttle cable 128. A coil spring 462 is provided for biasing the cam member 444 toward a direction that is opposite to the direction in which the cam member 444 is moved by the operation of the operator. The cam member 444 has a cam slot 466.

The cam follower 446 is also pivotally connected to the mount body 442. More specifically, the cam follower 446 has a connecting shaft portion 470 extending through a hole which is formed generally horizontally through the mount body 442. The end of the shaft portion 470 projects out from the through-hole and the horizontal bevel gear 450 is fitted onto this end via a bushing or collar 472. The bevel gear 450 is affixed to the shaft portion 470 by a lock pin 474. The cam follower 446 is configured as a crank shape. At another end of a crank portion 476, which is located opposite side of the shaft portion 470, is a pin portion 478. A cam follower member 480 is placed onto this pin portion 478 and then is fitted into the cam slot 466 of the cam member 444. The cam follower 446 thus pivots about an axis of the shaft portion 470 by the movement of the cam follower member 480 within the cam slot 466 when the cam member 444 is operated.

The mount body 442 also pivotally supports the vertical shaft 448. The vertical shaft 448 extends through a hole which is formed generally vertically through the mount body 442. The bottom end of vertical shaft 448 projects out from the hole downward and the bevel gear 452 is fitted onto this end via a collar 482. The bevel gear 452 is affixed to the vertical shaft 448 by a lock pin 484. An upper portion of the vertical shaft 448 is pivotally affixed to the side surface of the engine body 96 by a mount member 486. The mount member 486 is affixed to the engine body 96 by a pair of bolts 488. Both the bevel gears 450, 452 mesh with each other. The vertical shaft 448 thus pivots about its axis when the cam follower 446 pivots.

The control lever 454 is affixed atop the vertical shaft 448. A lock pin 492 prevents the control lever 454 from rotating around the vertical shaft 448. A control rod 494 couples the control lever 454 with the lever portion 384*a* of the manipulator 384. One end of the control rod 494 is affixed to an end portion of the control lever 454 by a ball joint 496, while the other end of the control rod 494 is affixed to the lever portion 384*a* of the manipulator 384 by another ball joint 498. The control rod 494 is affixed to the lever portion 384*a* at a portion that is farther from the pivot axis than a portion where the rod assembly 400 is affixed.

As seen in FIG. 9, the control lever 454 is positioned lower than the timing belt 164. The control rod 494 as well as the manipulator 194 and the rod assemblies 400, 404 is therefore placed in a space between a top surface of the engine body 96 and the timing belt 164.

In the illustrated embodiment, as seen in FIGS. 9 and 15, a flywheel cover member 499 extends over the valve levers 380, 382 so as to cover whole of the throttle valve linkage 126 as well as the flywheel 184 and the timing belt 164.

The operator can pull the throttle cable 128. If the throttle cable 128 is pulled and the connecting rod 461 moves as indicated by the arrow 500 of FIG. 9, the cam member 444 pivots counterclockwise in FIG. 9 as indicated by the arrow 502 against the biasing force by the spring 462. The cam follower member 480 moves upwardly within the cam slot 466 and hence the shaft portion 470 of the cam follower 446 also pivots counterclockwise in FIG. 9 (again indicated by the same arrow 502). Because of this pivotal movement of the shaft portion 470, the drive bevel gear. 450 pivots counterclockwise in FIG. 9 and clockwise in FIG. 16 as indicated by the arrow 504 of FIG. 16.

Figure 16:
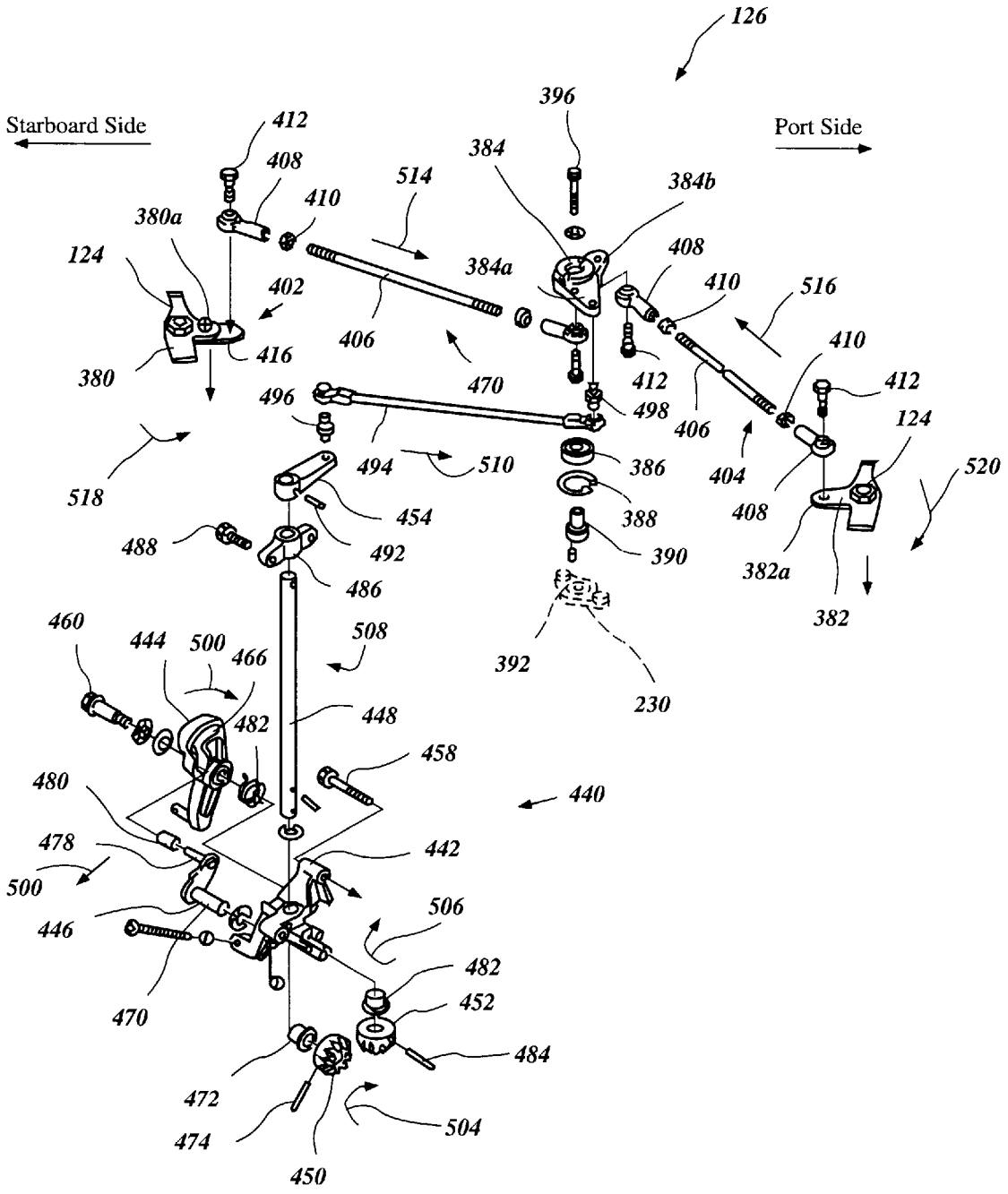
FIG. 16 is an exploded view of the throttle valve linkage. The figure shows a top portion of each throttle valve shaft and a lower portion thereof is omitted.
Figure 17:
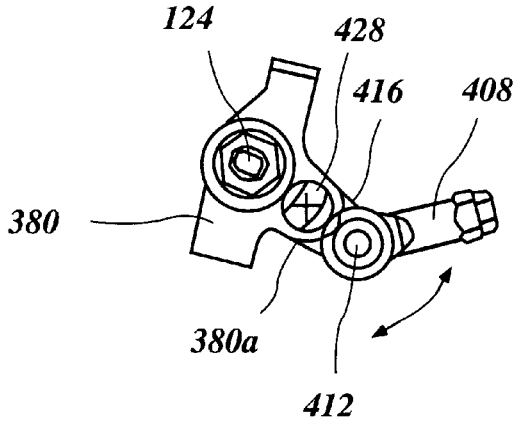
FIG. 17 is a top plan view of an adjustment mechanism of the valve linkage.
Figure 19:
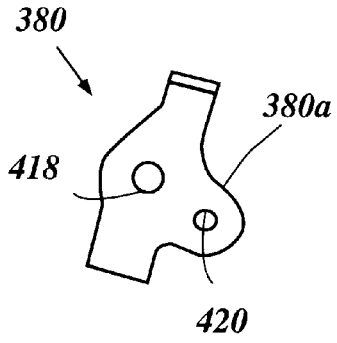
FIG. 19 is a plan view of a lever member used for the adjustment mechanism.
Figure 18:
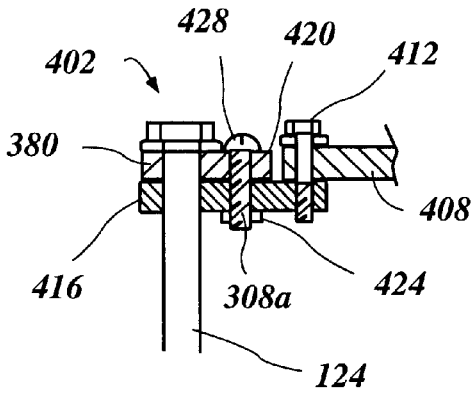
FIG. 18 is a sectional view of the adjustment mechanism.
Figure 20:
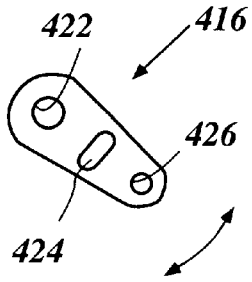
FIG. 20 is a plan view of an adjustment lever used for the adjustment mechanism.

The drive bevel gear 450 drives the driven bevel gear 452, which meshes with the drive bevel gear 450, clockwise in a top plan view as indicated by the arrow 506 of FIG. 16. The vertical shaft 448 thus pivots clockwise in FIG. 15 as indicated by the arrow 508 of FIGS. 15 and 16. This clockwise movement of the vertical shaft 448 pushes the control rod 494 through the control lever 454 as indicated by the arrow 510 of FIGS. 15 and 16 and pivotally moves the manipulator 384 counterclockwise in FIG. 15, as indicated by the arrow 512 of FIG. 15 through the lever portion 384*a*.

The counterclockwise movement of the manipulator 384 pulls both the rod assemblies 400, 404 as indicated by the arrows 514, 516 of FIGS. 15, 16 through the lever portions 384*a*, 384*b*. The rod assembly 400 thus moves the valve lever 380 counterclockwise in FIG. 15 as indicated by the arrow 518 of FIGS. 15 and 16, while the rod assembly 404 moves the valve lever 382 clockwise in FIG. 15 as indicated by the arrow 520 of FIGS. 15 and 16. These movements are synchronized, i.e., occur simultaneously.

The movements of the valve levers 380, 382 actuate the throttle valves 122 toward open positions. An amount of air flowing through air intake passages 102 increases and an amount of fuel also increases in proportion to the air amount. The engine 32 thus operates in a high speed.

When the operator releases the throttle cable 128, the biasing force of the spring 462 returns the cam member 444 toward its initial position. All the members and components of the throttle valve linkage 126 moves in directions that are opposite to the directions indicated by the foregoing arrows 500–520. As a result, both the air and fuel amounts decrease and the engine speed decreases.

As described above, in the illustrated embodiment that relates to the engine defining V-configuration, the manipulator is disposed generally between the air intake conduits on both sides of the engine body so as to be positioned on the engine body. The manipulator includes the pair of coupling rods coupled with the respective throttle valves. The throttle valve linkage thus can be placed easily in the relatively narrow space around the engine so as to the control throttle valves on both banks of V-configuration under a synchronized condition.

The combination of the cam slot and cam follower is advantageous because various throttle valve control characteristics can be obtained by changing the cam slot pattern.

It should be noted that the throttle valves can be other types such as a needle valve type. Also, some of the features of the present invention are practicable with an engine having cylinder bores extending vertically and a crankshaft extending horizontally.

The control mechanism is dispensable if the control characteristic by the cam combination is not necessary. In this variation, the throttle cable can be directly coupled with the lever portion of the manipulator.

Of course, the foregoing description is that of a preferred embodiment of the present invention, and various changes and modifications may be made without departing from the spirit and scope of the invention, as defined by the appended claims.

What is claimed is:

1. An internal combustion engine comprising a cylinder block having at least two cylinder banks arranged in a V-shaped configuration, each cylinder bank defining a cylinder bore, pistons reciprocating within the respective cylinder bores, a cylinder head member closing one end of each cylinder bores and defining a combustion chamber with the respective cylinder bore and piston, a crankshaft coupled with the pistons, a crankcase member attached to the cylinder block to close the opposite ends of the cylinder bores, the cylinder block, the cylinder head member and the crankcase member together defining an engine body, a first air intake conduit communicating with one of the combustion chambers and extending generally along a side surface of the engine body, a second air intake conduit communicating with another one of the combustion chambers and extending generally along another side surface of the engine body, the first air intake conduit having a first throttle valve regulating an amount of air flowing through the first air intake conduit, the second air intake conduit having a second throttle valve regulating an amount of air flowing through the second air intake conduit, valve mechanisms selectively connecting and disconnecting the combustion chambers with the air intake conduits, at least one camshaft arranged to actuate the valve mechanisms, a drive member coupling the camshaft and the crankshaft together so that the crankshaft drives the camshaft, and a manipulator to actuate both the first and second throttle valves, the manipulator including a pair of manipulating members coupled with the first and second throttle valves, the manipulator being disposed generally between the first and second air intake conduits on the engine body and between the engine body and the drive member.

2. An internal combustion engine as set forth in claim 1, wherein the drive member is a flexible transmitter.

3. An internal combustion engine comprising a cylinder block having at least two cylinder banks arranged in a V-shaped configuration, each cylinder bank defining a cylinder bore, pistons reciprocating within the respective cylinder bores, a cylinder head member closing one end of each cylinder bores and defining a combustion chamber with the respective cylinder bore and piston, a crankshaft coupled with the pistons, a crankcase member attached to the cylinder block to close the opposite ends of the cylinder bores, the cylinder block, the cylinder head member and the crankcase member together defining an engine body, the engine body defining a lubricant passage, the lubricant passage having an open end, the engine body including a closure member to close the open end of the lubricant passage, a first air intake conduit communicating with one of the combustion chambers and extending generally along a side surface of the engine body, a second air intake conduit communicating with another one of the combustion chambers and extending generally along another side surface of the engine body, the first air intake conduit having a first throttle valve regulating an amount of air flowing through the first air intake conduit, the second air intake conduit having a second throttle valve regulating an amount of air flowing through the second air intake conduit, and a manipulator to actuate both the first and second throttle valves, the manipulator including a pair of manipulating members coupled with the first and second throttle valves, the manipulator being disposed generally between the first and second air intake conduits on the engine body, and the manipulator being affixed to the closure member.

4. An internal combustion engine comprising a cylinder block having at least two cylinder banks arranged in a V-shaped configuration, each cylinder bank defining a cylinder bore extending generally horizontally, pistons reciprocating within the respective cylinder bores, a cylinder head member closing one end of each cylinder bores and defining a combustion chamber with the respective cylinder bore and piston, a crankshaft coupled with the pistons, a crankcase member attached to the cylinder block to close the opposite ends of the cylinder bores, the cylinder block, the cylinder head member and the crankcase member together defining an engine body, a first air intake conduit communicating with one of the combustion chambers and extending generally along a side surface of the engine body, a second air intake conduit communicating with another one of the combustion chambers and extending generally along another side surface of the engine body, the first air intake conduit having a first throttle valve regulating an amount of air flowing through the first air intake conduit, the second air intake conduit having a second throttle valve regulating an amount of air flowing through the second air intake conduit, and a manipulator to actuate both the first and second throttle valves, the manipulator including a pair of manipulating members coupled with the first and second throttle valves, the manipulator being disposed generally between the first and second air intake conduits and being positioned atop the engine body.

5. An internal combustion engine as set forth in claim 4, wherein the manipulator is pivotally affixed to the engine body, and the manipulating members are configured to actuate the throttle valves when the manipulator pivots.

6. An internal combustion engine as set forth in claim 4 additionally comprising an adjustment mechanism disposed between at least one of the manipulating members and the first and second throttle valves.

7. An internal combustion engine as set forth in claim 4 additionally comprising a control mechanism arranged to control the manipulator, wherein the control mechanism is mounted on an engine body.

8. An internal combustion engine as set forth in claim 7, wherein the cylinder bores extend generally horizontally, and the manipulator is positioned atop the engine body, and the control mechanism is positioned at a side surface of the engine body.

9. An internal combustion engine as set forth in claim 8, wherein the control mechanism is positioned between the engine body and one of the air intake conduits.

10. An internal combustion engine as set forth in claim 7, wherein the control mechanism includes a bevel gear set.

11. An internal combustion engine as set forth in claim 4, wherein each one of the banks of the V-configuration includes a plurality of cylinder bores.

12. An internal combustion engine as set forth in claim 4, wherein the engine powers a marine propulsion device.

13. An internal combustion engine comprising a cylinder block having at least two cylinder banks arranged in a V-shaped configuration, each cylinder bank defining a cylinder bore extending generally horizontally, pistons reciprocating within the respective cylinder bores, a cylinder head member closing one end of each cylinder bore and defining a combustion chamber with the respective cylinder bore and piston, a crankshaft coupled with the pistons, a crankcase member closing the other ends of the cylinder bores, the cylinder block, the cylinder head member and the crankcase member together defining an engine body, a first air intake conduit communicating with one of the combustion chambers and extending generally along a side surface of the engine body, a second air intake conduit communicating with another one of the combustion chambers and extending generally along another side surface of the engine body, the first air intake conduit having a first throttle valve arranged for pivotal movement about a first valve axis, the second air intake conduit having a second throttle valve arranged for pivotal movement about a second valve axis, and a manipulator journaled at a top surface of the engine body for pivotal movement about a manipulator axis, the manipulator including a pair of coupling rods connected to the first and second throttle valves, the first and second throttle valves being actuated for the pivotal movement about the first and second axes, respectively, by the coupling rods when the manipulator pivots about the manipulator axis.

14. An internal combustion engine as set forth in claim 13, wherein the coupling rods are affixed to different portions of the manipulator, and the portions are positioned generally oppositely to each other relative to the third axis.

15. The internal combustion engine as set forth in claim 13, wherein the first and second throttle valves have lever members, and the respective coupling rods are connected with the respective lever members.

16. The internal combustion engine as set forth in claim 13, wherein the first and second valve axes and the manipulator axis extend generally vertically.

17. The internal combustion engine as set forth in claim 13, wherein the first and second valve axes and the manipulator axis extend generally parallel to each other.

18. An internal combustion engine comprising a cylinder block having at least two cylinder banks arranged in a V-shaped configuration, each cylinder bank defining a cylinder bore, pistons reciprocating within the respective cylinder bores, a cylinder head member closing one end of each cylinder bore and defining a combustion chamber with the respective cylinder bore and piston, a crankshaft coupled with the pistons, a crankcase member closing the other ends of the cylinder bores, the cylinder block, the cylinder head member and the crankcase member together defining an engine body, a first air intake conduit communicating with one of the combustion chambers and extending generally along a side surface of the engine body, a second air intake conduit communicating with another one of the combustion chambers and extending generally along another side surface of the engine body, the first air intake conduit having a first throttle valve arranged for pivotal movement about a first valve axis, the second air intake conduit having a second throttle valve arranged for pivotal movement about a second valve axis, and a manipulator journaled at the engine body for pivotal movement about a manipulator axis, the manipulator including a pair of coupling rods connected to the first and second throttle valves, the first and second throttle valves being actuated for the pivotal movement about the first and second axes, respectively, by the coupling rods when the manipulator pivots about the manipulator axis, the first and second throttle valves having lever members, the respective coupling rods being connected with the respective lever members, at least one of the lever members being formed with at least a first piece and a second piece, the first piece being connected to the first or second throttle valve, the second piece being connected to the coupling rod, and the first and second pieces being connected together so that an angle defined therebetween can selectively be changed.

19. An internal combustion engine as set forth in claim 18, wherein both the first and second pieces have through-holes, at least one of the through-holes is a slot, and the first and second pieces are coupled together by a fastening member passing through the through-holes.

20. An internal combustion engine comprising a cylinder block having at least two cylinder banks arranged in a V-shaped configuration, each cylinder bank defining a cylinder bore, pistons reciprocating within the respective cylinder bores, a cylinder head member closing one end of each cylinder bore and defining a combustion chamber with the respective cylinder bore and piston, a crankshaft coupled with the pistons, a crankcase member closing the other ends of the cylinder bores, the cylinder block, the cylinder head member and the crankcase member together defining an engine body, the engine body defining a lubricant passage, the lubricant passage having an open end, the engine body including a closure member to close the open end of the lubricant passage, a first air intake conduit communicating with one of the combustion chambers and extending generally along a side surface of the engine body, a second air intake conduit communicating with another one of the combustion chambers and extending generally along another side surface of the engine body, the first air intake conduit having a first throttle valve arranged for pivotal movement about a first valve axis, the second air intake conduit having a second throttle valve arranged for pivotal movement about a second valve axis, and a manipulator being journaled at the closure member for pivotal movement about a manipulator axis, the manipulator including a pair of coupling rods connected to the first and second throttle valves, the first and second throttle valves being actuated for the pivotal movement about the first and second axes, respectively, by the coupling rods when the manipulator pivots about the manipulator axis.

21. An internal combustion engine comprising a cylinder block defining at least one cylinder bore, a piston reciprocating within the cylinder bore, a cylinder head member closing one end of the cylinder bore and defining a combustion chamber with the cylinder bore and the piston, the cylinder block further defining a lubricant passage through which lubricant passes, the lubricant passage having an open end, a closure member closing the open end, an air intake conduit communicating with the combustion chamber, the air intake conduit including a throttle valve admitting air to the combustion chamber, and a valve actuator arranged to actuate the throttle valve, the valve actuator being affixed to the closure member.

22. The internal combustion engine as set forth in claim 21 additionally comprising a crankshaft coupled with the piston, a crankcase member closing the other end of the cylinder bore, the cylinder block, the cylinder head member and the crankcase member defining an engine body, a control mechanism arranged to control the valve actuator, wherein the air intake conduit extends along the cylinder block, and the control mechanism is positioned between the engine body and the air intake conduit.

23. The internal combustion engine as set forth in claim 21, wherein the control mechanism is mounted on the engine body.

24. An internal combustion engine comprising an engine body defining at least two banks spaced apart from each other generally horizontally, moveable members moveable relative to the respective banks, the engine body and the moveable members together defining a combustion chamber at each one of the banks, a first air intake conduit extending generally along a side surface of the engine body to communicate with one of the combustion chambers, the first air intake conduit including a first throttle valve arranged to regulate air flow through the first air intake conduit, a second air intake conduit extending generally along another side surface of the engine body to communicate with another one of the combustion chambers, the second air intake conduit including a second throttle valve arranged to regulate air flow through the second air intake conduit, and a manipulator disposed atop the engine body to actuate both the first and second throttle valves, the manipulator including a pair of connecting members coupled with the first and second throttle valves.

25. The engine as set forth in claim 24 additionally comprising an adjustment mechanism arranged to adjust positions of both the first and second throttle valves so that the respective air flow amounts of the first and second air intake conduits are generally the same as each other, the adjustment mechanism being disposed between at least one of the connecting members and one of the first and second throttle valves.

26. The engine as set forth in claim 24, wherein the engine body forms a fluid passage defining an open end, the engine body includes a closure member to close the open end, and the manipulator is affixed to the closure member.

27. An internal combustion engine comprising an engine body defining at least two banks spaced apart from each other generally horizontally, moveable members moveable relative to the respective banks, the engine body and the moveable members together defining a combustion chamber at each one of the banks, a first air intake conduit extending generally along a side surface of the engine body to communicate with one of the combustion chambers, the first air intake conduit including a first throttle valve journaled for pivotal movement about a first axis, a second air intake conduit extending generally along another side surface of the engine body to communicate with another one of the combustion chambers, the second air intake conduit including a second throttle valve journaled for pivotal movement about a second axis, and a manipulator journaled at a top surface of the engine body for pivotal movement about a third axis, the manipulator including a pair of connecting members coupled with the first and second throttle valves, and the first and second throttle valves being actuated for the pivotal movement about the first axis and the second axis, respectively, by the connecting members when the manipulator pivots about the third axis.

28. The engine as set forth in claim 27, wherein the first, second and third axes extend generally vertically.

29. The engine as set forth in claim 27, wherein the first, second and third axes extend generally parallel to each other.

30. An internal combustion engine comprising an engine body defining at least two banks, moveable members moveable relative to the respective banks, the engine body and the moveable members together defining a combustion chamber at each one of the banks, a first air intake conduit extending generally along a surface of the engine body to communicate with one of the combustion chambers, the first air intake conduit including a first throttle valve journaled for pivotal movement about a first axis, a second air intake conduit extending generally along another surface of the engine body to communicate with another one of the combustion chambers, the second air intake conduit including a second throttle valve journaled for pivotal movement about a second axis, and a manipulator journaled at the engine body for pivotal movement about a third axis, the manipulator including a pair of connecting members coupled with the first and second throttle valves, the first and second throttle valves being actuated for the pivotal movement about the first axis and the second axis, respectively, by the connecting members when the manipulator pivots about the third axis, and the first, second and third axes extending generally parallel to each other, wherein the banks are spaced apart from each other generally horizontally, and the first, second and third axes extend generally vertically.

* * * * *